US007394024B2

(12) United States Patent
Kohayashi et al.

(10) Patent No.: US 7,394,024 B2
(45) Date of Patent: Jul. 1, 2008

(54) OXIDE SUPERCONDUCTOR CURRENT LEAD AND METHOD OF MANUFACTURING THE SAME, AND SUPERCONDUCTING SYSTEM

(75) Inventors: Shuichi Kohayashi, Tokyo (JP); Kazuyuki Uemura, Tokyo (JP); Shigeo Nagaya, Nagoya (JP); Naoji Kashima, Nagoya (JP)

(73) Assignees: Dowa Mining Co., Ltd., Tokyo (JP); Chubu Electric Power Co., Inc., Nagoya-shi (JP)

( * ) Notice: Subject to any disclaimer, the term of this patent is extended or adjusted under 35 U.S.C. 154(b) by 0 days.

(21) Appl. No.: 10/771,381

(22) Filed: Feb. 5, 2004

(65) Prior Publication Data

US 2004/0222011 A1 Nov. 11, 2004

(30) Foreign Application Priority Data

| | | |
|---|---|---|
| Feb. 6, 2003 | (JP) | 2003-030057 |
| Mar. 14, 2003 | (JP) | 2003-070062 |
| Mar. 14, 2003 | (JP) | 2003-070507 |
| Feb. 4, 2004 | (JP) | 2004-028451 |
| Feb. 4, 2004 | (JP) | 2004-028470 |

(51) Int. Cl.
*H01B 12/00* (2006.01)

(52) U.S. Cl. ..... 174/125.1; 29/599

(58) Field of Classification Search ..... 174/125.1, 174/15.4, 15.5; 29/599; 505/230, 885, 925, 505/926, 220, 236, 706
See application file for complete search history.

(56) References Cited

U.S. PATENT DOCUMENTS

| | | | | |
|---|---|---|---|---|
| 5,623,240 | A * | 4/1997 | Sakuraba et al. | 335/216 |
| 5,786,304 | A * | 7/1998 | Kimura et al. | 505/234 |
| 6,034,324 | A * | 3/2000 | Dixon et al. | 174/15.4 |
| 6,194,226 | B1 | 2/2001 | Sato et al. | 438/2 |
| 6,235,685 | B1 * | 5/2001 | Maeda et al. | 505/470 |
| 6,339,194 | B1 * | 1/2002 | Larsen et al. | 174/125.1 |
| 2002/0020546 | A1 | 2/2002 | Ueyama et al. | 174/125.1 |
| 2003/0213611 | A1 | 11/2003 | Morita | 174/126.2 |

FOREIGN PATENT DOCUMENTS

| | | | |
|---|---|---|---|
| JP | 63-200307 | | 8/1988 |
| JP | 405279140 | A * | 10/1993 |
| JP | 407099111 | A * | 4/1995 |
| JP | 40909763 | A * | 4/1997 |

* cited by examiner

*Primary Examiner*—Ishwar (I. B.) Patel
(74) *Attorney, Agent, or Firm*—Oliff & Berridge, PLC

(57) ABSTRACT

An oxide superconductor current lead in which generation of Joule heat at joint portions with a system side conductor and a power supply side conductor is reduced with use of an oxide superconductor with less heat penetration into a super conducting equipment system is provided. A columnar oxide superconductor molten bodies (interelectrode superconductor 260, in-electrode superconductors 280*a* and 280*b*) are produced, the in-electrode superconductor 280*a* and a left end portion of the interelectrode superconductor 260 are placed into a power supply side metallic electrode 210, and the in-electrode superconductor 280*b* and a right end portion of the interelectrode superconductor 260 are similarly placed in a system side metallic electrode 211, then degassed joining metal is used to join them to form an oxide superconductor current lead 201, a power supply side conductor 5 from a power supply is joined to the power supply side metallic electrode 210, and a system side conductor 202 from a superconducting system side is joined to the system side metallic electrode 211 with use of respective clamps 203*a* and 203*b*.

10 Claims, 16 Drawing Sheets

FIG.7

| | | TREATMENT CONDITION | TREATMENT TEMPERATURE | HOLE VOLUME RATE | 77 K CONTACT RESISTANCE VALUE |
|---|---|---|---|---|---|
| EXAMPLE 1 | RIGHT | VACUUM DEGASSING + ULTRASONIC SOLDERING IRON TREATMENT | 180℃ | 0.07% | 0.19μΩ |
| EXAMPLE 1 | LEFT | VACUUM DEGASSING + ULTRASONIC SOLDERING IRON TREATMENT | 180℃ | 0.08% | 0.19μΩ |
| EXAMPLE 2 | RIGHT | VACUUM DEGASSING + ULTRASONIC SOLDERING IRON TREATMENT | 180℃ | 0.10% | 0.20μΩ |
| EXAMPLE 2 | LEFT | VACUUM DEGASSING + ULTRASONIC SOLDERING IRON TREATMENT | 180℃ | 0.10% | 0.21μΩ |
| EXAMPLE 3A | RIGHT | VACUUM DEGASSING + ULTRASONIC SOLDERING IRON TREATMENT | 180℃ | 0.06% | 0.28μΩ |
| EXAMPLE 3A | LEFT | VACUUM DEGASSING + ULTRASONIC SOLDERING IRON TREATMENT | 180℃ | 0.07% | 0.29μΩ |
| EXAMPLE 3B | RIGHT | VACUUM DEGASSING + ULTRASONIC SOLDERING IRON TREATMENT | 180℃ | 0.07% | 0.30μΩ |
| EXAMPLE 3B | LEFT | VACUUM DEGASSING + ULTRASONIC SOLDERING IRON TREATMENT | 180℃ | 0.08% | 0.29μΩ |
| EXAMPLE 4 | RIGHT | VACUUM DEGASSING + ULTRASONIC SOLDERING IRON TREATMENT | 160℃ | 5% | 0.30μΩ |
| EXAMPLE 4 | LEFT | VACUUM DEGASSING + ULTRASONIC SOLDERING IRON TREATMENT | 160℃ | 4% | 0.27μΩ |
| COMPARISON EXAMPLE 1 | RIGHT | ONLY ULTRASONIC SOLDERING IRON TREATMENT | 160℃ | 30% | 0.8μΩ |
| COMPARISON EXAMPLE 1 | LEFT | ONLY ULTRASONIC SOLDERING IRON TREATMENT | 160℃ | 35% | 0.9μΩ |
| COMPARISON EXAMPLE 1 | RIGHT | ONLY ULTRASONIC SOLDERING IRON TREATMENT | 180℃ | 50% | 1.2μΩ |
| COMPARISON EXAMPLE 1 | LEFT | ONLY ULTRASONIC SOLDERING IRON TREATMENT | 180℃ | 45% | 1.1μΩ |

POWER SUPPLY SIDE
SYSTEM SIDE
CURRENT DIRECTION
B
C
D
201
202
203a
203b
205
206a
206b
210
211
230a
230b
260
270
280a
280b
340
341

B TO B SECTION
221a
250a
210
280a
206a
205

C TO C SECTION
280
270

D TO D SECTION
221b
250b
211
280b
206b
341
342
202

A TO A SECTION

B TO B SECTION

FIG.16

| | TEMPERATURE 77 K RESISTANCE VALUE [μΩ] | TEMPERATURE 4.2 K RESISTANCE VALUE [μΩ] |
|---|---|---|
| OVERLAYING OF ELECTRODES WITH PLACEMENT OF SUPERCONDUCTOR | 0.28 | 0.2 |
| OVERLAYING OF ELECTRODES WITHOUT PLACEMENT OF SUPERCONDUCTOR | 3.23 | 2.6 |
| OVERLAYING OF ELECTRODE WITH PLACEMENT OF SUPERCONDUCTOR AND ELECTRODE WITHOUT IT | 1.52 | 1.22 |

FIG.17

| | TEMPERATURE 77 K RESISTANCE VALUE [μΩ] | TEMPERATURE 4.2 K RESISTANCE VALUE [μΩ] |
|---|---|---|
| OVERLAYING OF ELECTRODES WITH PLACEMENT OF SUPERCONDUCTOR | 0.27 | 0.21 |
| OVERLAYING OF ELECTRODES WITHOUT PLACEMENT OF SUPERCONDUCTOR | 3.5 | 2.65 |
| OVERLAYING OF ELECTRODE WITH PLACEMENT OF SUPERCONDUCTOR AND ELECTRODE WITHOUT IT | 1.68 | 1.29 |

OXIDE SUPERCONDUCTOR CURRENT LEAD AND METHOD OF MANUFACTURING THE SAME, AND SUPERCONDUCTING SYSTEM

BACKGROUND OF THE INVENTION

1. Field of the Invention

The present invention relates to an oxide superconductor current lead to be used when supplying a current to a superconducting system used in an MRI, linear, SMES and the like, and to a method of manufacturing the same, and a superconducting system.

2. Description of the Related Art

A current lead, which is used when a large current is supplied to superconducting equipment such as a superconducting magnet, is for supplying a current of several hundreds to several thousands amperes to a cryogenic superconducting system from a power supply in a room temperature region. As the current lead, a copper wire with a low electrical resistance value is conventionally used. However, when the copper wire is used as a current lead, and a predetermined large current is passed through this, Joule heat is generated. Then, when a copper wire with a large wire diameter is used to reduce generation of Joule heat, heat penetration due to thermal conduction occurs to a side of the super conducting system via the copper wire having the large wire diameter, this time. As a result, power loss of a cryocooler and loss of a He gas as a refrigerant due to the heat penetration become serious. Thus, it is proposed in Patent Document 1 to include an oxide superconductor, which does not generate Joule heat even if a large current is passed through it, in the middle of this current lead.

[Patent Document 1]

Japanese Utility Model Laid-open No. 63-200307

Recently, development of superconductivity application equipment is advanced, and the level of the performance demanded of the oxide superconductor current leads becomes high, as a result of which, less heat penetration from the outside is demanded in addition to capability of passing a larger current, and less generation of Joule heat.

Here, the following factors are considered as the factors of Joule heat generation.

1) There is heat generation caused by contact resistance of joint portions of the oxide superconductor in the oxide superconductor current lead and metallic electrodes. The heat generation occurs because the oxide superconductor used for the oxide superconductor current lead is made of ceramics and has unfavorable joinability with metal, and thus the electric resistance (hereinafter, described as contact resistance) which cannot be ignored occurs to joint surfaces with the metallic electrodes (generally, a copper electrodes are used). Consequently, when a predetermined current is passed through the oxide superconductor current lead, heat is generated.

2) There is heat generation caused by resistance of the metallic electrodes themselves.

3) There is heat generation caused by contact resistance, following the transfer of a current at the joint portion of a mating conductor drawn out of the superconducting system side (hereinafter, described as the system side conductor) and the metallic electrode.

4) There is heat generation caused by contact resistance following the transfer of a current at the joint portion of a mating conductor drawn out of the power supply side (hereinafter, described as the power supply side conductor) and the metallic electrode.

Consequently, in order to reduce the value of the aforementioned contact resistance, interposing silver between the oxide superconductor and the copper electrodes in the form of the silver coat was tried first. Namely, paying attention to the fact that the contact resistance value between silver and the oxide superconductor is lower than the contact resistance value between copper and the oxide superconductor, silver foil is crimped to, a silver paste material is coated on, or silver is attached by thermal-spraying to the oxide superconductor, thereafter this is baked to be made silver coat, and this oxide superconductor with the silver coat and the copper electrodes are joined by using joining metal such as, for example, solder to form the oxide superconductor current lead.

However, as a result that a current passed through the current lead increases, generating Joule heat is not be ignorable with the current lead using the aforementioned oxide superconductor with the silver coat. Consequently, in order to reduce generation of Joule heat as passing a predetermined current though the current lead, the oxide superconductor is upsized, and the contact area with the copper electrodes is made larger.

As a result, though generation of Joule heat can be reduced, it becomes necessary to upsize the oxide superconductor to take the contact area of the oxide superconductor and the copper electrodes, and heat penetration from the high temperature side to the low temperature side is increased via the upsized oxide superconductor.

Thus, the oxide superconductor current lead as shown in, for example, FIG. 6 is considered.

In an oxide superconductor current lead 100 shown in FIG. 6, copper electrodes 120 as metallic electrodes are connected to both sides of a rare-earth based oxide superconductor 110 produced by the melting method, which is capable of passing a large current even with a small sectional area. Both end portions 112 of the rare-earth based oxide superconductor 110 have large sectional areas, but a central portion 111 has a small sectional area. Meanwhile, in the copper electrodes 120, contact portions 121 in contact with both the end portions 112 of the oxide superconductor are scraped to wrap up the both end portions 112, so that both of them can secure the large contact area.

This oxide conductor current lead 100 can restrain both the generation of Joule heat, and heat penetration from a high temperature side to a low temperature side even if a predetermined current is passed through it.

However, in the rare-earth based oxide superconductor produced by the melting method, which is suitable for the current lead among the oxide superconductors, it is difficult to produce a molded body with only a central portion being constricted to be slim as shown in FIG. 6. For this reason, in order to produce an oxide superconductor in such a shape, it is firstly necessary to produce a rare-earth based oxide superconductor in a rectangular parallelepiped shape of a size capable of securing a sufficient contact area with the metallic electrodes, and next, it is necessary to take a step of making a sectional area small by performing cutting work for the central portion in order to reduce heat penetration via the rare-earth based oxide superconductor. However, with this method, when a predetermined current value passed through the oxide superconductor current lead is large, a large-sized rare-earth based oxide superconductor is produced, and the large-sized rare-earth based oxide superconductor has to be cut large, thus reducing yields of the rare-earth based oxide superconductor and requiring a large number of man-hours. Further, the portions of the metallic electrodes are upsized, and therefore it is difficult to reduce the size of the entire oxide superconductor current lead.

Further, it has been considered that the contact resistance values at the joint portions of the metallic electrode and the system side conductor, and the metallic electrode and the power supply side conductor are reduced if the joint areas in the joint portions are made large. However, the problem that the reduction effect of the contact resistance value remains small even if the aforesaid joint area is only made large.

Thus, improvement in the joining method in the joint portions of the metallic electrodes, and the system side conductor and the power supply side conductor is tried by using different methods from the aforementioned silver coat interposal, and upsizing of the contact areas of the oxide superconductor and the copper electrodes, and various methods such as welding, brazing, crimping with various kinds of plating treatment being applied to the joint interfaces of both of them, and crimping with soft metal such as In flake at room temperature or the like being sandwiched between the joint interfaces of both of them have been carried out.

However, if the methods of heating the joint portions, such as welding and brazing are adopted for improvement in joining, thermal load is applied to the oxide superconductor in the current lead, as a result of which, the phenomenon that the oxide superconductor becomes rid of oxygen occurs, and the characteristics of the oxide superconductor are sometimes deteriorated. Further, even if the joint portions are welded or the like, variations in the contact resistance value in the joint interface of both of them cannot be restrained completely, and when a large current is passed, a drift current occurs to cause an increase in the contact resistance value.

When soft metal at room temperature, such as an. In flake or the like is sandwiched in the joint interface of the metallic electrode and the system side conductor and crimped or the like, variations in the contact resistance value in the joint interface of both of them cannot be restrained completely, and when a large current is passed, a drift current occurs to cause an increase in the contact resistance value.

Consequently, the object which the present invention is to attain is to provide an oxide superconductor current lead in which generation of Joule heat at joint spots with a system side conductor and a power supply side conductor is reduced, with use of an oxide superconductor with less heat penetration to a superconducting equipment system.

SUMMARY OF THE INVENTION

The present invention is made to attain the above-described object, and has the following constitution.

A first constitution is an oxide superconductor current lead in which metallic electrodes are provided at both sides of an oxide superconductor, joining metal is provided at joint portions formed by the oxide superconductor and the metallic electrodes, and the oxide superconductor and the metallic electrodes are joined by the joining metal, and a volume of holes in the joining metal provided at the joint portions is 5% or less of a volumetric capacity of the joint portions.

A second constitution is in the oxide superconductor current lead described in the first constitution, silver coat is provided on a surface of the oxide superconductor joined by the joining metal.

A third constitution is in the oxide superconductor current lead described in the first or the second constitution, the joining metal is solder including one or more kind or kinds of cadmium, zinc, and antimony, and one or more kind or kinds of lead, tin, and indium.

A fourth constitution is a method of manufacturing an oxide superconductor current lead in which metallic electrodes are provided at both sides of an oxide superconductor, joining metal is' provided at joint portions formed by the oxide superconductor and the metallic electrodes, and the oxide superconductor and the metallic electrodes are joined by the joining metal, and comprises degassing the joining metal by decompressing the joint portions after heating the joint portions to a temperature of a melting point of the joining metal or higher, when joining the oxide superconductor and the metallic electrodes by the joining metal.

A fifth constitution is in the method of manufacturing an oxide superconductor current lead described in the fourth constitution, on heating and degassing the joining metal, sealing members which, restrain the joining metal from flowing out of the joint portions, are provided.

A six constitution is a superconducting system, wherein the oxide superconductor current lead described in any one of the first to the third constitution is used.

A seventh constitution is an oxide superconductor current lead which is provided with metallic electrodes at both ends of an oxide superconductor, and transfers a current from and to mating conductors joined to the metallic conductors, wherein in at least one of the metallic electrodes, the oxide superconductor is placed in the metallic electrode to be substantially in parallel with an interface between the metallic electrode and the mating conductor.

An eighth constitution is in the oxide superconductor current lead described in the seventh constitution, the oxide superconductor has a columnar shape, and is placed so that a longitudinal direction thereof is substantially in parallel with the interface, A ninth constitution is in the oxide superconductor current lead described in the seventh or the eighth constitution, the oxide superconductor is an oxide superconductor produced by a melting method.

A tenth constitution is in the oxide superconductor current lead described in any one of the seventh to the ninth constitution, the oxide superconductor is an oxide superconductor made by joining a plurality of oxide superconductors.

An eleventh constitution is in the oxide superconductor current lead described in any one of the seventh to the tenth constitution, the metallic electrodes and the one or more superconductor or superconductors are joined by joining metal, and a volume of holes in the joining metal constitutes 5% of a volumetric capacity of joint portions or less.

A twelfth constitution is a superconducting system, wherein the oxide superconductor current lead according to any one of the seventh to the eleventh constitution is used.

On conceiving the first constitution, the inventors produced the sample of the oxide superconductor current lead, measured the values of the contact resistance on the joint surfaces of the oxide superconductor and the metallic electrodes in detail, and found out that the value of the contact resistance was not constant for each sample of the oxide superconductor current lead samples. Thus, in order to study the cause of the variations of the contact resistance value, the joint surfaces of the oxide superconductor and the metallic electrodes were exploded in detail over the entire surface and study them.

As a result, it was found out that there were the holes in the joining metal on the joint surfaces of the oxide superconductor and the metallic electrodes. It was also found out that when the volumes of the holes in the joining metal were totaled, the volume of the holes substantially constitutes 30% or more of the volumetric capacity of the joint portions. Thus, when the volume of the holes in the joining metal was made 5% or less of the volumetric capacity of the joint portions, the contact resistance values of the oxide superconductor and the metallic electrodes were reduced, and it became possible to join the oxide superconductor to the metallic electrodes without enlarging the sectional area of the oxide superconductor in the contact portions of the oxide superconductor and the metallic electrodes, and to restrain generating Joule heat even if a predetermined current was passed.

According to the second constitution, the contact resistance values of the oxide superconductor and the metallic electrodes can be further reduced and a predetermined current is stably passed by interposing the silver coat between the joining metal and the oxide superconductor.

According to the third constitution, with use of solder including any one or more kind or kinds of cadmium, zinc, and antimony, and any one or more kind or kinds of lead, tin and indium, as the joining metal, detaching of the metallic electrodes and the oxide superconductor, and a crack of the oxide superconductor can be restrained, therefore enabling the oxide superconductor current lead with use of the aforementioned solder as the joining metal to pass a predetermined current stably.

According to the fourth constitution, the joining metal used for the oxide superconductor current lead is decompressed and degassed after being heated to be higher than the melting point, whereby the volume of the holes in the joining metal provided at the joint portions can be reduced.

According to the fifth constitution, on degassing the joining metal, the sealing members, which restrain outflow of the joining metal, are provided at the portions, where the joint of the joining metal is in contact with the outside, to restrain the joining metal from flowing out of the joint portions, whereby occurrence of holes due to insufficiency of the amount of joining metal can be avoided at the joint portions, and the joining metal can avoid diffusing to the portions other than the joint portions and raising the contact resistance value of the diffusion portions.

In the sixth constitution, since the superconducting system using the oxide superconductor current lead according to any one of the first to the third constitutions has less heat penetration from the high temperature side to the low temperature side when a predetermined current is passed, the load on the cryocooler can be reduced, and the superconducting system with low production cost and running cost is provided.

According to the seventh constitution, in the oxide superconductor current lead, the contact resistance value between the metallic electrodes which transfer a current to and from the mating conductors is reduced, and Joule heat generating in this portion can be restrained.

According to the eighth constitution, since the oxide superconductor has the columnar shape, it can be easily placed in the metallic electrodes in parallel with the interfaces with the mating conductors, and it becomes possible to constitute the compact electrodes.

According to the ninth constitution, the oxide superconductor produced by the melting method is high in the critical current density, and large in the mechanical strength, and therefore the oxide superconductor current lead having favorable electrical characteristics and mechanical characteristics can be produced.

According to the tenth constitution, the production cost of the oxide superconductor current lead can be reduced by using the oxide superconductor made by joining a plurality of oxide superconductors as the oxide superconductor.

According to the eleventh constitution, if the volume of the holes in the connecting metal which joins the one or more oxide superconductor or oxide superconductors to the metallic electrodes is. 5% or less of the volumetric capacity of the joint portions, passage of the current in these portions is made smooth, and the contact resistance value when a predetermined current is passed to the oxide superconductor current lead is reduced, whereby Joule heat generating in these portions can be restrained.

In the twelfth constitution, since the superconducting system using the oxide superconductor current lead according to any one of the seventh to the eleventh constitution has less heat penetration from the high temperature side to the low temperature side even when a predetermined current is passed, the load on the cryocooler can be reduced, and the superconducting system at the low production cost and the running cost is provided.

BRIEF DESCRIPTION OF THE DRAWINGS

FIG. 7 is a list of treatment conditions and evaluation results of examples 1 to 4 and a comparison example;

FIG. 16 is a list of the calculation results of the characteristics of the current lead according to example 1; and FIG. 17 is a list of the calculation results of the characteristics of the current lead according to example 2.

DETAILED DESCRIPTION OF THE PREFERRED EMBODIMENT(S)

A first embodiment according to a first to a sixth constitution, and a second embodiment according to a seventh to a twelfth constitution will be mainly explained, in the present invention, hereinafter.

First Embodiment

The first embodiment of the present invention will be explained with reference to the drawings hereinafter.

Figure 1:
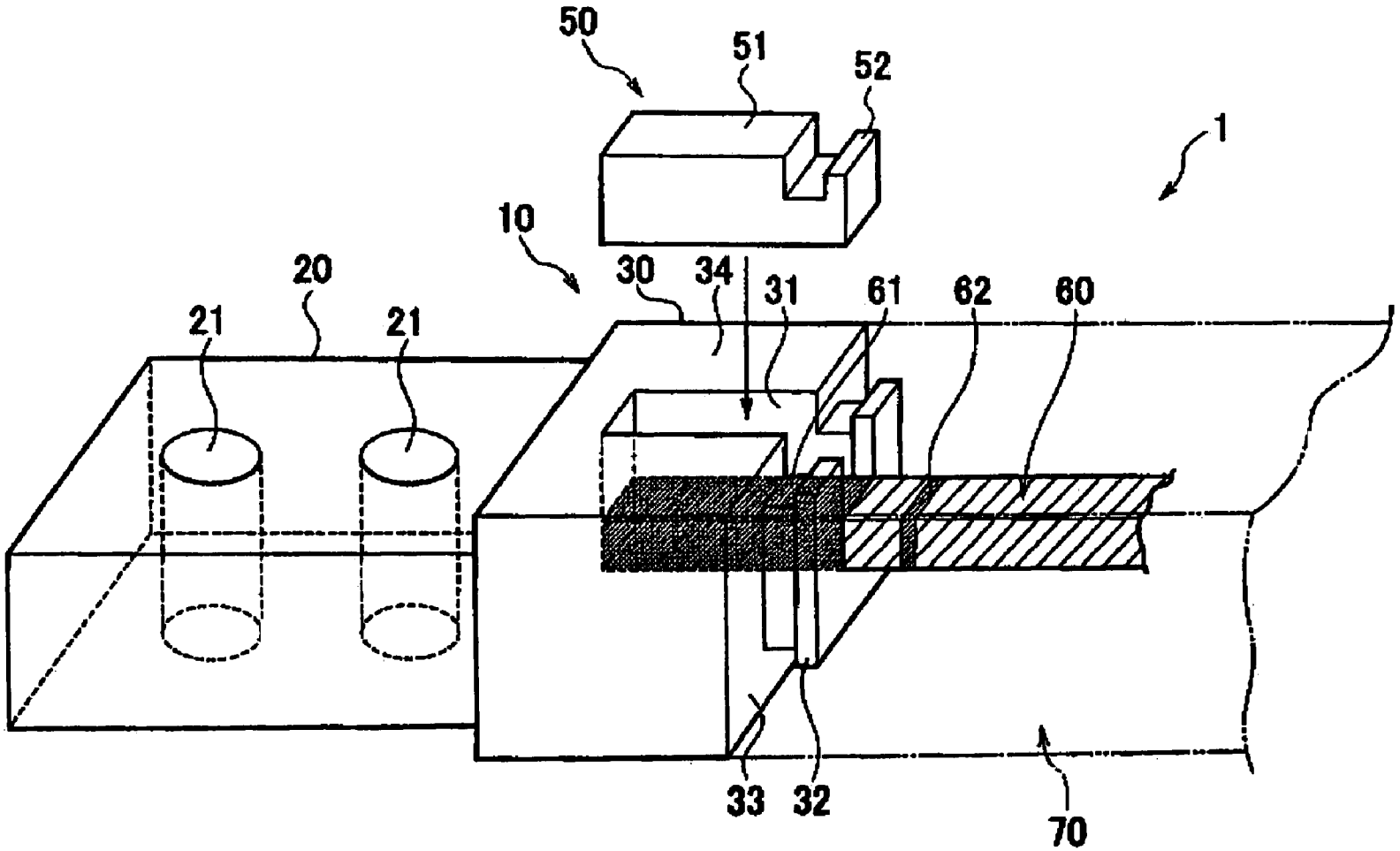
FIG. 1 is a perspective view showing a placement example of a superconductor into a metallic electrode of a current lead according to the present invention.
Figure 2:
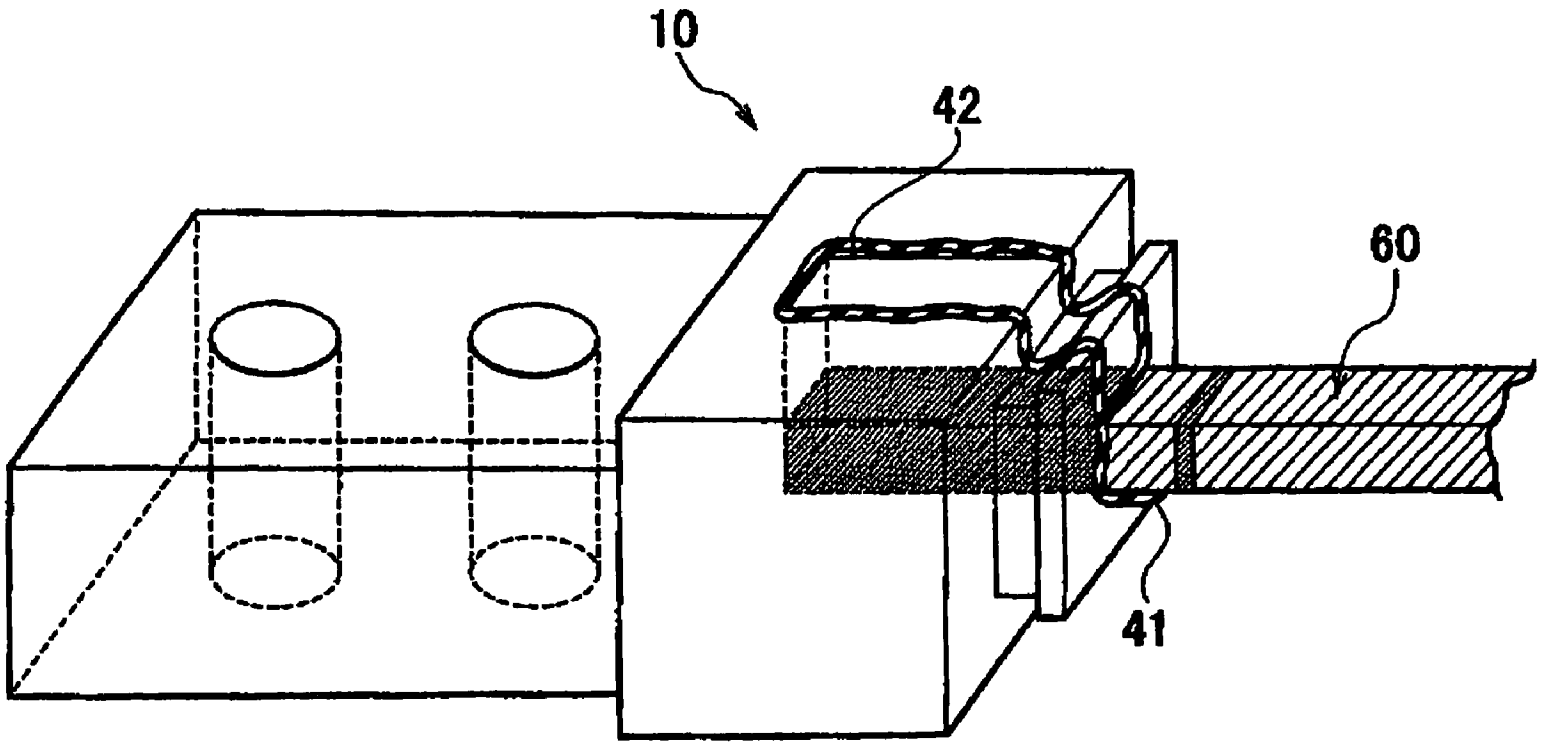
FIG. 2 is a perspective view of a case in which a sealing member is provided at the metallic electrode shown in FIG. 1.
Figure 3:
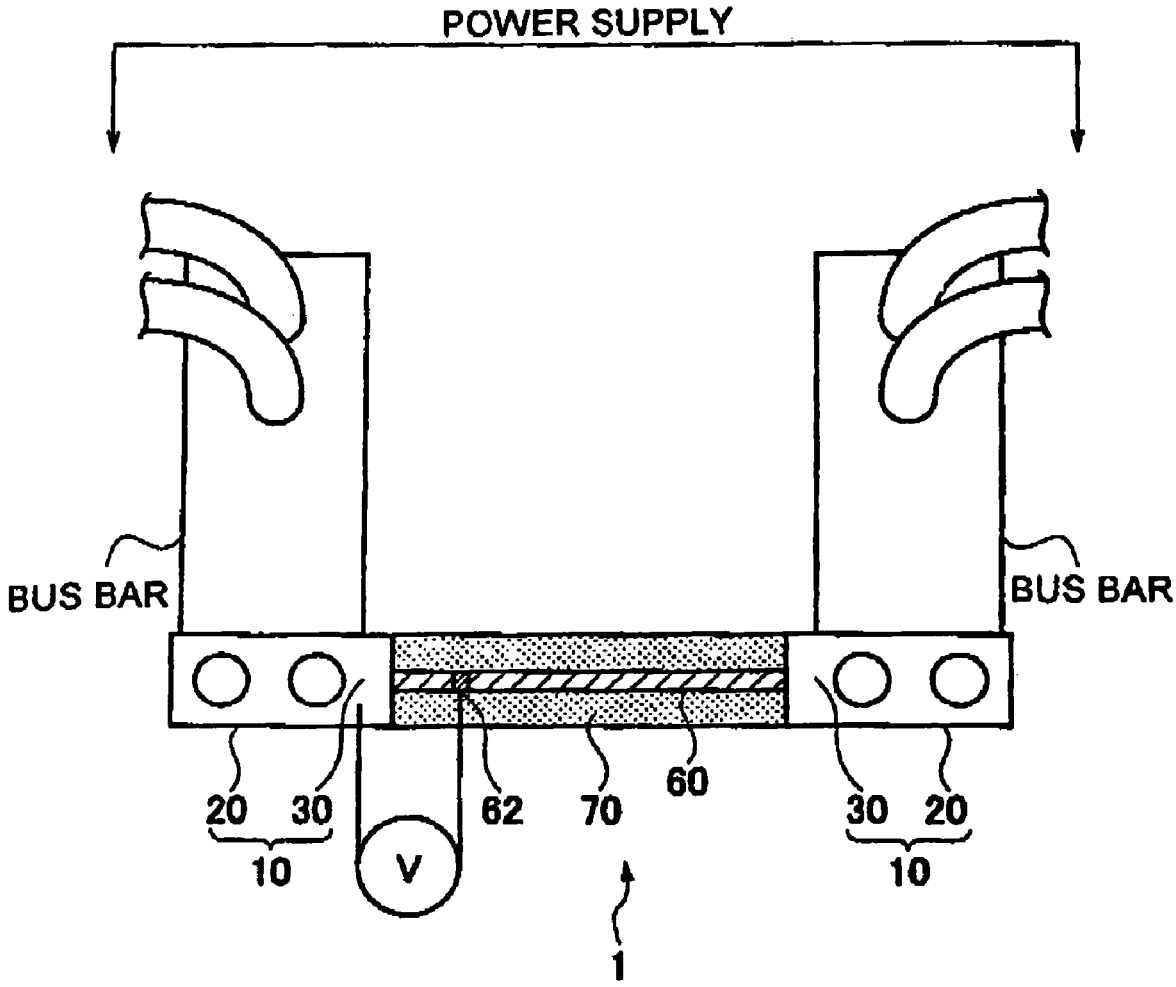
FIG. 3 is a conceptual diagram of measurement of characteristics of an oxide superconductor current lead according to the present invention.
Figure 4:
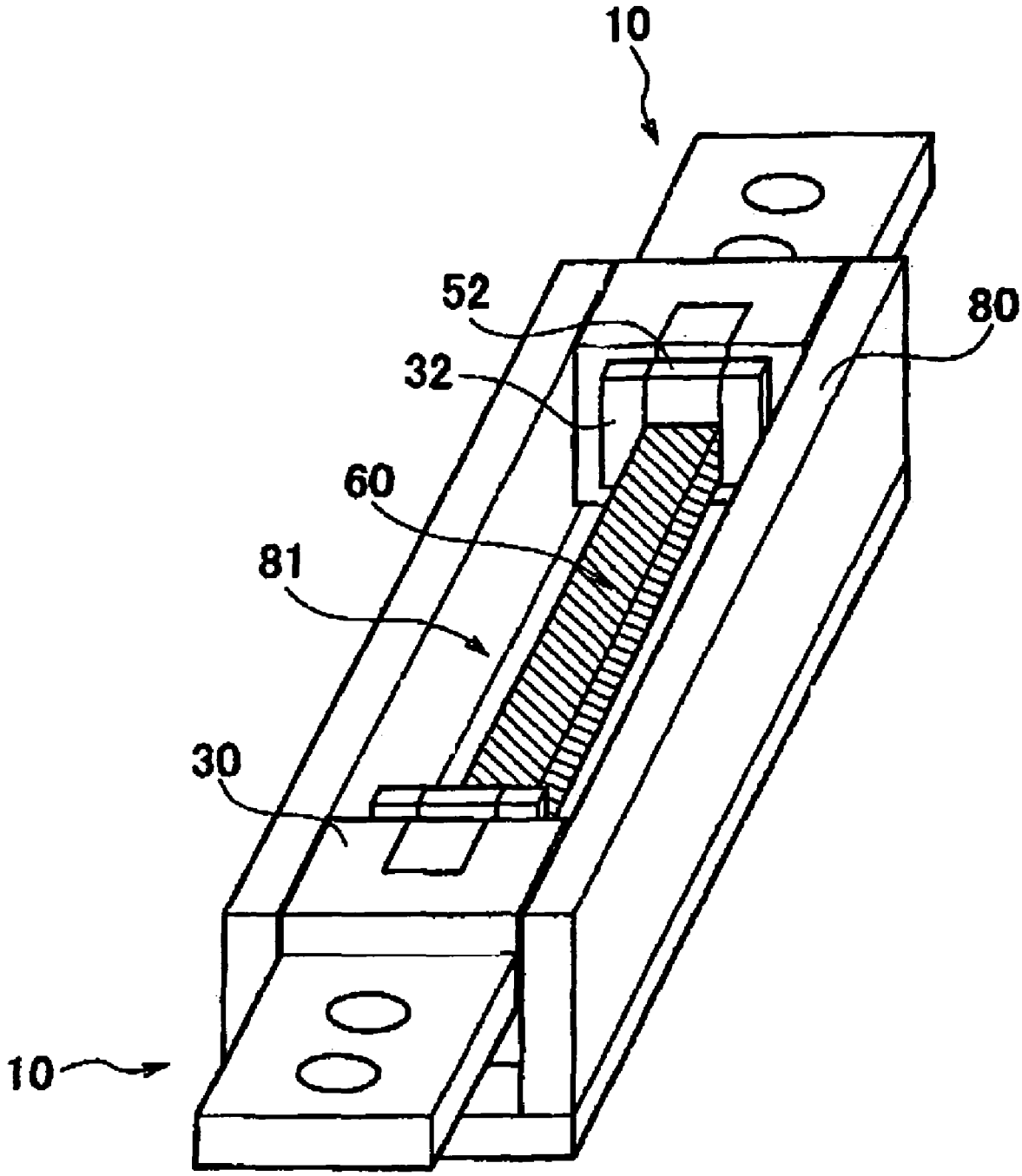
FIG. 4 is a perspective view when a joined body of the oxide superconductor and the metallic electrodes is housed in a mold.
Figure 5:
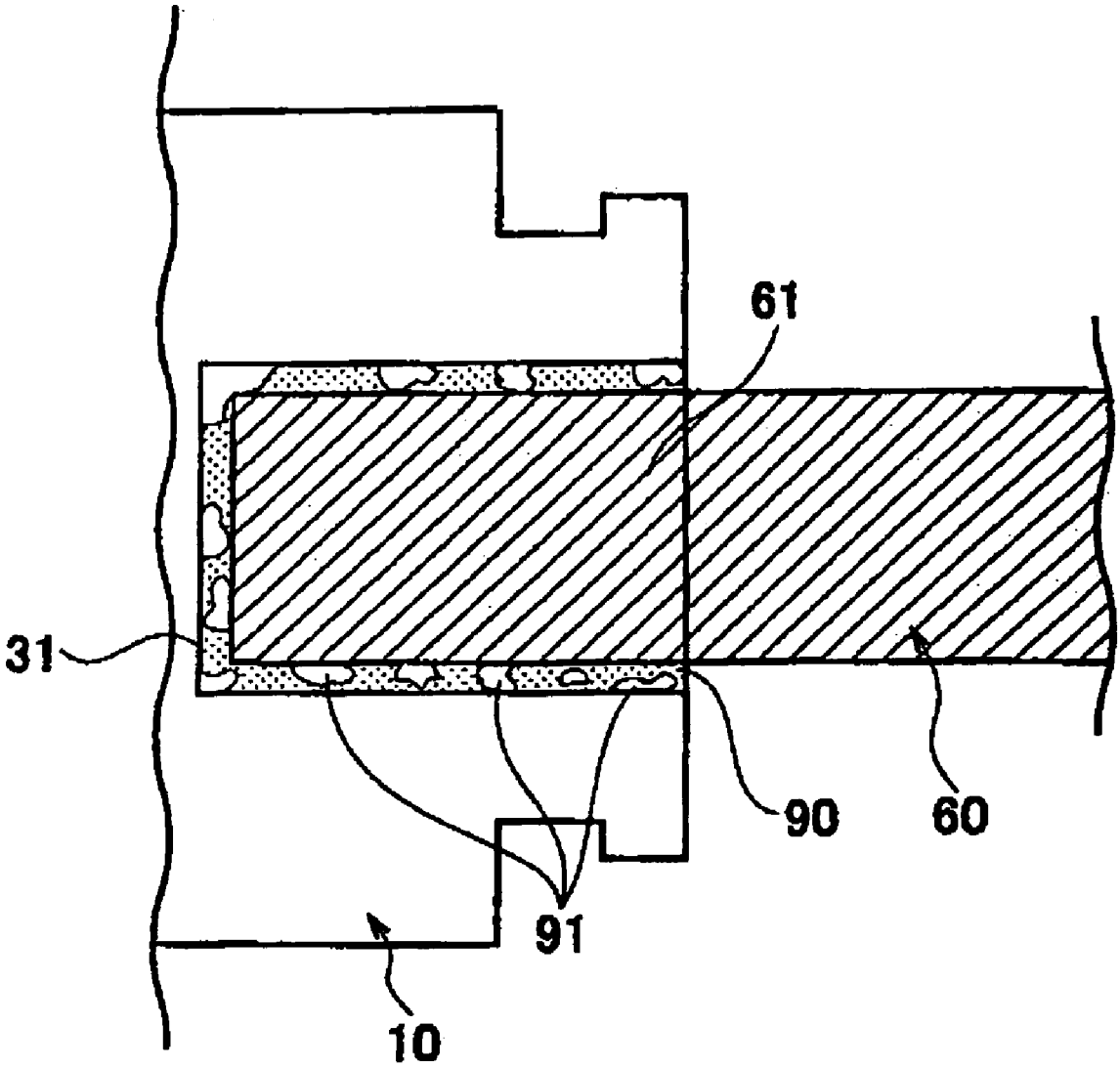
FIG. 5 is a cross sectional view of a joint portion of an oxide superconductor and a metallic electrode according to a prior art.
Figure 6:
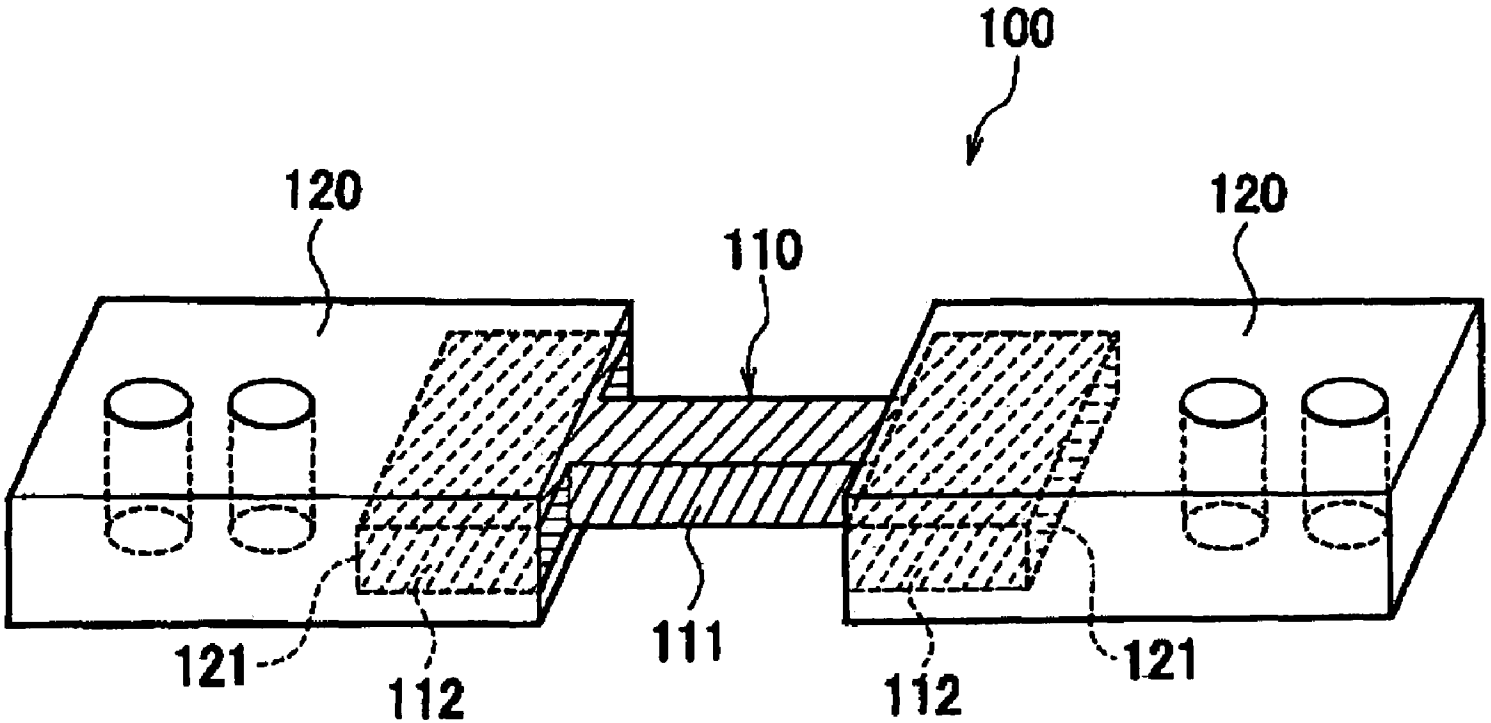
FIG. 6 is a perspective view of an oxide superconductor current lead according to a precursory invention.

FIG. 1 is a perspective view showing a placement example of an oxide superconductor to a metallic electrode in an oxide superconductor current lead according to the present invention, FIG. 2 is a perspective view in a case in which a sealing member is provided at the metallic electrode in which the oxide superconductor shown in FIG. 1 is placed, FIG. 3 is a conceptual diagram of measurement of characteristics of an oxide superconductor current lead according to the present invention, FIG. 4 is a perspective view when the aforesaid joined body is housed in a mold to coat the joined body of the oxide superconductor and the metallic electrodes with a coating member, and FIG. 5 is a schematic cross sectional view of a joint portion of the oxide superconductor and the metallic electrode in an oxide superconductor current lead made by a prior art.

In FIG. 1, an oxide superconductor current lead (hereinafter, described as a current lead) according to the present invention has a metallic electrode 10, a drift current restraining member 50, an oxide superconductor 60, and a coating member 70. Though not shown, the same metallic electrode as the metallic electrode 10 is provided opposite thereto at the other end of the oxide superconductor 60.

First, the metallic electrode 10 has a tabular lead wire joining portion 20, and an oxide superconductor placement portion (hereinafter, described as a placement portion) 30 in a rectangular parallelepiped shape. The lead wire joining portion 20 is provided with a desired number of lead wire placement holes 21 for a lead wire, a bus bar and the like to be placed. Meanwhile, an oxide superconductor placement groove (hereinafter, described as a placement groove) 31 is provided at a top surface 34 and an opposing surface 33, and the opposing surface 33 is provided with an oxide superconductor support portion (hereinafter, described as a support portion) 32 in a U shape with an upper portion being opened to surround the placement groove 31. It is preferable to previously provide plating with the element or alloy of tin, silver, gold, nickel, zinc, or palladium as a main component, or a layered body of the aforesaid plating, on an inner wall of the placement groove 31 to enhance adhesion with joining metal that will be described later, and on the lead wire joining portion 20 to reduce contact resistance with a lead wire, a bus bar and the like which are to be joined here.

Next, the drift current restraining member 50 has a drift current restraining member main body 51 and a drift current restraining member protruding portion (hereinafter, described as a protruding portion) 52, and has a shape capable of being fitted into the aforementioned placement groove 31, and after it is fitted into the placement groove 31, the drift current restraining member 50 is integrated with the metallic electrode 10. It is also preferable to provide the plating with the element or the alloy of tin, silver, gold, nickel, zinc, or palladium as the main component, or the layered body of the aforesaid plating, on the drift current restraining member 50 and the placement groove 31 to enhance adhesion with the joining metal which will be described later Next, the oxide superconductor 60 has a square rod shape, and both ends of the square rod are each provided with silver coat 61. In this embodiment, measurement silver coat 62 is provided at a proper position from the end portion of the square rod for evaluation of the electric characteristics of the current lead, which will be described later.

Further, a covering member 70 which covers the oxide superconductor 60 is provided between the opposing surfaces 33 of the metallic electrodes 10, which oppose to each other, sandwiching the oxide superconductor 60 in the square rod shape. The covering member 70 is supported by the support portions 32 provided at the opposing surfaces 33 and fixed to the metallic electrodes 10.

Here, it is preferable to use a rare-earth based oxide superconductor made by the melting method, which is capable of passing a large current even with a small sectional area, for the oxide superconductor 60. This is because heat penetration to a cryogenic superconducting magnet can be further reduced by reducing the sectional area of the oxide superconductor 60 necessary to pass a predetermined current.

In addition, since the oxide superconductor 60 has substantially the same sectional area over the entire body, it can be produced by cutting from the oxide superconductor which is a base material, and a larger cutting work is not needed after the cutting from the base material.

Next, placement of the oxide superconductor 60 and the drift current restraining member 50 into the metallic electrode 10 will be explained. The placement groove 31 provided at the metallic electrode 10 has the shape into which an end portion of the oxide superconductor 60 is fitted, but considering that a large current of 1000 A or more passes through this portion, it is preferable that the width, height and depth of the placement groove 31 is 3×3×10 mm or more.

The end portion of the oxide superconductor 60 is placed in this placement groove 31, and the drift current restraining member 50 is placed further thereon. It is preferable that a clearance between this drift restraining member 50 and the placement groove 31 is about 0.05 to 0.5 mm at one side. The clearance between the drift current restraining member 50 and the placement groove 31 becomes a degassing portion 42, which will be explained in FIG. 3. If the clearance is 0.05 mm or more, it is preferable because degassing of the joining metal advances sufficiently, and if it is 0.5 mm or less, it is preferable because an unnecessary rise in the contact resistance value due to an increase in the volumetric capacity of the joining metal can be avoided.

Returning to FIG. 2 again, it is preferable that when the drift current restraining member 50 is placed into the placement groove 31, the drift current restraining member main body 51 is in a size to be substantially flush with the top surface 34 and the opposing surface 33 of the metallic electrode, and the protruding portion 52 is in a size to be integrated with the support portion 32. When the end portion of the oxide superconductor 60 is placed into the placement groove 31, and the drift current restraining member 50 is further placed thereon, a portion enclosed by the metallic electrode 10 including the placement groove 31 and the drift current restraining member 50, and the end portion of the oxide superconductor 60 constitute a joint portion.

It is preferable that a silver coat 62 is applied onto five surfaces of the oxide superconductor 60 constituting the joint portion, which oppose the placement groove 31 and the drift current restraining member 50, from the viewpoint of reducing the contact resistance of this portion. As a method of the silver coat, a coating and baking method, a plating method, a vapor deposition method, a sputtering process, a thermal spraying method and the like of a silver paste material are applicable, and therefore any of these methods can be properly selected from the viewpoint of productivity, and mass productivity. It is preferable to perform melt-coating of joining metal for joining the oxide superconductor 60 to the placement groove 31, on this silver coat 61. As this joining metal, various' kinds of solder having the melting point of 300° C. or lower are preferably used to avoid the oxide superconductor being heated to become rid of oxygen. Among them, from the viewpoint of increase in adhesiveness of the joint portion and reduction in the contact resistance, it is desirable to use Pb—Sn based and In based soldering materials with doping of Cd, Zn, Sb and the like so that adhesiveness with, for example, ceramics and coating properties are enhanced. Namely, solder including any one or more kind or kinds of Cd, Zn and Sb, and any one or more kind or kinds of Pb, Sn and In has high adhesive strength with the metallic electrode and the oxide superconductor. Consequently, even if a stress occurs between the metallic electrode and the oxide superconductor due to a linear expansion difference between the metallic electrode and the oxide superconductor because of heat history from liquid-nitrogen temperature or the lower temperature than this to the room temperature, concentration of this stress on a local spot can be avoided. As a result, it is considered that occurrence of detaching of the metallic electrode and the oxide superconductor and a crack of the oxide superconductor can be restrained, and rise in resistance or the like does not occur for the repeated heat history, so that a predetermined current can be stably passed.

Here, as a preferable example of a solder material for ceramics, Cerasolzer (trade name) is described.

Cerasolzer 143 made by Asahi Glass Co., Ltd.

Components: Sn: 45 to 51 (Wt %), Pb: 26 to 32, Cd: 16 to 22, Zn: 2 to 4, Sb: 1 to 3

Melting point: 143° C.

Cerasolzer 123 made by Asahi Glass Co., Ltd.

Components: In: 44 to 50 (Wt %), Cd: 45 to 50, Zn: 1 to 3, Sb: less than 1

Melting point: 123° C.

By adopting the constitution in which the end portion of the oxide superconductor 60 is fitted into the placement groove 31 provided at the metallic electrode 10, and the drift current restraining member 50 is placed thereon to form the joint portion, at which the joining metal is provided to join the metallic electrode 10 and the oxide superconductor 60, the metallic electrode 10 and the oxide superconductor 60 are electrically joined all in a surface contact state, and therefore this is preferable because the contact resistance value of this portion can be reduced. As the other embodiments than this, it is naturally possible to adopt the embodiment in which the metallic electrode is formed into a cap shape, and the oxide superconductor is fitted into it, or the embodiment in which the metallic electrode has the dividable structure, and the metallic electrode is assembled in such a manner as the oxide superconductor is inserted into it, and the structure of the oxide superconductor may be in a circular column shape or a circular cylindrical shape.

Melt-coating of the joining metal is applied inside the placement groove 31, into which the oxide superconductor 60 with melt-coating of the joining metal being applied on the silver coat is placed, and molten joining metal is placed to the joint portion formed by the oxide superconductor 60 and the placement groove 31, and both of them are joined by solidifying the molten joining metal.

In joining by using this joining metal, the molten joining metal is placed on the oxide superconductor 60 and the wall of the placement groove 31, and therefore when coating, injection or the like is performed, a gaseous component such as air is taken therein. The gaseous component taken into the molten joining metal forms holes inside when the joining metal is solidified. If the holes are formed inside the joining metal, a passage of a current passing between the metallic electrode and the oxide superconductor via the joining metal is narrowed, and it is considered that at the time of passing a predetermined current, for example, a current of 1000 A, this portion is the cause of the increase in the contact resistance value.

Here, relationship of the contact resistance value between the metallic electrode and the oxide superconductor, and the joining metal in which the holes are formed will be explained with reference to FIG. 5.

In FIG. 5, the portion, to which the silver coat 61 is applied, of the oxide superconductor 60 is placed in the placement groove 31 provided in the metallic electrode 10, and joining metal 90 is provided at the joint portion constituted of the metallic electrode 10 and the oxide superconductor. 60. When the metallic electrode 10 and the oxide superconductor 60 were joined by using the Joining metal 90 according to the prior art, the holes 91 exist in the joining metal 90. A proportion, which the volume of the holes 91 constitutes in the volumetric capacity of the joint portion, can be measured by, for example, the following method. Namely, the joint portion is sequentially cut, then the proportions of the area of the section of the joint portion and the sectional area of the holes 91 are measured, and the values are sequentially added up.

It has been revealed that when the metallic electrode 10 and the oxide superconductor 60 are joined by using the joining metal 90 according to the method of the prior art, the proportion, which the volume of the holes 91 constitutes in the volumetric capacity of the joint portion, is about 50%. The existence of the holes 91 in the joining metal 90 is considered to be the factor of the contact resistance value between the metallic electrode and the oxide superconductor.

Consequently, as the method of restraining and avoiding the generation of the holes in the joining metal, it was considered to perform coating of the aforementioned joining metal in a vacuum. However, it has been conceived that from the viewpoint of operability and productivity, it is preferable to perform coating of the joining metal in the air, then place the oxide superconductor 60 into the placement groove 31 and heat them to melt the joining metal, then when joining them, expose this portion to a vacuum, and remove the gaseous component in the joining metal by a vacuum degassing method. As the condition of the vacuum degassing, the heating temperature for the joining metal may be the melting point or higher, but from the viewpoint of advancing the degassing in a short time and restraining oxidation of the joining metal, it is desirable to set the heating temperature at about the melting point +15 to 100° C. Though the effect can be obtained when the degree of the ambient vacuum is 0.01 MPa or lower, but 10 Pa or lower is more desirable because degassing is completed in four to five seconds. With the temperature and time at this level, it is not necessary to consider that the oxide superconductor 60 becomes rid of oxygen.

Further, if the molten joining metal flows out of the placement groove 31 and diffuses to the other portions of the metallic electrode 10 on the occasion of the vacuum degassing, the joining metal amount becomes insufficient inside the placement groove 31, while in the portions with the diffused joining metal, the diffused joining metal causes a rise in the contact resistance value in these portions, which are both unfavorable, and therefore it is preferable to adopt the constitution which restrains this.

A concrete constitution example which restrains the outflow of the joining metal will be explained with use of FIG. 2.

In FIG. 2, the end portion of the oxide superconductor 60 is placed into the placement groove 31 provided in the metallic electrode 10. The sealing member 41 is placed along an outer peripheral portion of the placement groove 31 and the oxide superconductor. When the sealing member 41 is placed along the outer periphery portion of the placement groove 31, it is preferable to place the sealing member 41 not to close the degassing portion 42 formed by fitting the drift current restraining member 50 into the placement groove 31. As the sealing member 41, silicon rubber or the like, which is not deteriorated at the temperature of the melting point of the joining metal or higher, has proper adhesiveness to the metallic electrode 10 and the oxide superconductor 60, and is easily placed, can be approximately used.

When placement of the sealing member 41 to the metallic electrode 10 is completed, the metallic electrode 10 and the oxide superconductor 60 are heated to the temperature higher than the melting point of the joining metal by 15 to 100° C., and when the joining metal is degassed in a vacuum according to the aforementioned condition, a generating gaseous component is discharged from the degassing portion 42. In this situation, when viscosity of the molten joining metal is high and the generated holes are difficult to rupture, it is preferable to add mechanical impact to rupture the generated holes by using an ultrasonic transducer of an ultrasonic soldering iron, for example, and perform vacuum degassing again. In this embodiment, after vacuum degassing of the gaseous component from the molten joining metal is performed, the drift current restraining member 50 is fitted into the placement groove 31, and vacuum degassing is performed again. At this time, by adding a mechanical impact via the drift current restraining member 50, rupture of the holes in the molten joining metal can be easily realized. As a result of this, it becomes possible to reduce the volume of the holes in the joining metal placed in the joint portion formed by the placement groove 31 of the metallic electrode 10, the drift current restraining member 50 and the oxide superconductor 60 to 5% or less of the volumetric capacity of the joint portion.

Here, a plurality of current lead samples having various values of the ratio of the volumetric capacity of the joint portion and the holes in the joining metal are produced with the degassing condition of the joining metal being changed. The contact resistance values of the joint portions of the produced current lead samples were measured by using the contact resistance value measuring method that will be described later, and the relationship between the ratios of the volumetric capacities of the joint portions and the holes in the joining metals, and the contact resistance values were obtained.

Here, as an example of the oxide superconductor 60, a Gd based oxide superconductor produced by the melting method, which has the rectangular parallelepiped shape of 3 mm high, 5 mm wide and 90 mm long, was used. The Gd based oxide superconductor was in this size for the purpose of making heat penetration via the oxide superconductor 0.3 W or less. Naturally, the sectional shape may be a square or a circle. Each of the both end portions of 10 mm of the Gd based oxide superconductor was joined to each of the metallic electrode (at this time, the joining area of the oxide superconductor and the metallic electrodes is 175 $mm^2$.) The contact resistance value was measured with the ratio of the holes in the joining metal to the volumetric capacity of the joint portion being changed.

Then, when the degassing operation of the joining metal was not performed, the ratio of the holes in the joining metal was about 30 to 50% of the volumetric capacity of the joint portion, the contact resistance value when the predetermined current was passed was about 0.8 to 1.2 μΩ, and variations of the contact resistance values according to the samples were large. However, when the ratio of the holes in the joining metal became 5% or less of the volumetric capacity of the joint portion, the constant resistance value when the predetermined current was passed fell short of 0.5 μΩ, and at the same time, variations in the contact resistance value were smaller.

Here, an amount of penetrating heat via the Gd based oxide superconductor is 0.3W or less as described above, it is found out that the penetrating heat amount to the low temperature side, which is the total of the heat penetration due to the heat conduction and Joule heat generation by the contact resistance at the time of passing a current of 1000 A when the low temperature side is cooled to 4.2 K, is sufficiently below 0.5 W.

Accordingly, it is found out that even when the oxide superconductor is in the shape which is cut out of the base material, and large cutting work is not performed, it is usable as the oxide superconductor current lead. As a result, in comparison with the oxide superconductor current lead which requires cutting work for the oxide superconductor, it becomes possible to reduce the use amount of the oxide superconductor by far and at the same time, it becomes possible to reduce the entire oxide superconductor current lead in size.

Here, returning to FIG. 1, when joining of the metallic electrodes 10 and the oxide superconductor 60 is completed, it is preferable to remove the sealing member, and provide the covering member 70 between the metallic electrodes 10 provided at both ends of the columnar oxide superconductor 60 to oppose each other in such a manner as to cover the oxide superconductor 60. The covering member 70 is to protect the oxide superconductor 60 mechanically and environmentally, and therefore GFRP or the like being a resin material including glass fibers is preferably used.

From the above, by using the oxide superconductor current lead for the superconducting system, cooling efficiency of the superconducting system is remarkably improved, and reduction in production cost by making the cryocooler capacity compact and the like, and reduction in running cost of the system can be realized.

A process step of providing the covering member onto the oxide superconductor will be explained by using FIG. 4.

FIG. 4 is a perspective view showing a state in which the oxide superconductor with the metallic electrodes being joined to the both ends is placed into a mold which is for covering the oxide superconductor with the covering member.

In FIG. 4, the oxide superconductor 60 with the aforementioned metallic electrodes 10 being joined to the both ends is placed in a mold 80. The placement portions 30 of the metallic electrodes 10 and the mold 80 having a U-shaped section form a mold space 81. The oxide superconductor support portions 32 and the drift current restraining member protruding portions 52 protrude toward the mold space 81 from the metallic electrodes 10 at both sides.

Meanwhile, glass fibers are impregnated with thermoset resin to prepare pre-preg of GFRP. The prepared pre-preg of GFRP is charged into the mold space 81, and hardened by heat to be the covering member for the oxide superconductor 60. As a result, the covering member is fitted onto the drift restraining member protruding portions 52 and the oxide superconductor support portions 32 which protrude from the metallic electrodes 10 and exhibit mechanical strength, and therefore the current lead, which is mechanically and environmentally strong and excellent in electrical characteristics, can be produced.

Characteristics evaluation of the produced current lead will be explained with use of FIG. 3.

In FIG. 3, the oxide superconductor 60 is 5 mm wide and 3 mm thick, and Ag paste is baked onto the position of 10 mm in width at both end portions thereof, and the positions which are from 15 to 17 mm from the both end portions. Up to the positions which are 10 mm in width at the both end portions, the Ag paste is joined to the metallic electrodes 10 as the silver coats 61, and lead wires are connected to the positions up to 15 to 17 mm from the both end portions as the measuring silver coats 62. Bus-bars are connected to the lead wire joining portions 20 of the metallic electrodes 10 at two spots provided at the current lead 1, and each of the bus-bars is connected to the power supply (not shown). As the power supply, the power supply, which supplies the current of, for example, 1060A, as the predetermined current, is used. The current passes through the placement portion 30 from the lead wire joining portion 20, flows through the oxide superconductor covered with the covering member 70, and reaches the placement portion 30 of the opposing metallic electrode 10.

A potential difference between the placement portion 30 and the position which is 15 mm from the end of the oxide superconductor 60 when this current lead 1 was cooled to 77 K and the current of 1060 A is passed between both the bus-bars is measured, and a contact resistance value R of this portion is calculated from the measured value.

Hereinafter, based on examples, the first embodiment will be further explained in detail.

EXAMPLE 1

1) Production of the Columnar Oxide Superconductor

After each raw material powder of $Sm_2O_3$, $BaCO_3$, and CuO was weighed so that Sm:Ba:Cu=1.6:2.3:3.3 in mole ratio, only $BaCO_3$ and CuO were calcined at 880° C. for 30 hours, and calcined powder of $BaCuO_2$ and CuO was obtained ($BaCuO_2$: CuO=2.3:1.0 in mol ratio). Next, The aforesaid $Sm_2O_3$, which was previously weighed, was added to this calcined powder, to which Pt powder (average grain size of 0.01 μm) and $Ag_2O$ powder (average grain size of 13.8 μm) were further added and mixed, and this was calcined in the air at 900° C. for 10 hours to be the calcined powder including Ag. It should be noted that Pt content was 0.42 wt % and Ag content was 15 wt %. The calcined powder including Ag was ground by the pot mill, the average grain size was made about 2 μm, and the synthetic powder was obtained.

When the obtained synthetic powder was analyzed by powder X-ray diffraction, the $Sm_{1+p}Ba_{2+q}(Cu_{1-b}Ag_b)_3O_{7-x}$ phase and the $Sm_{2+r}Ba_{1+s}(Cu_{1-d}Ag_d)O_{5-y}$ phase were confirmed.

This synthetic powder was press-molded into the plate-shape which was 77 mm long, 106 mm wide and 26 mm thick, and thereby the precursor was produced. Then, this precursor was placed in the furnace and the following process steps were performed.

First, the temperature was raised from the room temperature to 1100° C. in 70 hours, and after the precursor was kept at this temperature for 20 minutes and brought into the semi-molten state, the temperature gradient of 5° C./cm was added from the top to the bottom of the precursor so that the top portion of the precursor was at the low temperature side, and the temperature was reduced at 0.4° C./min until the temperature of the top portion became 1025° C.

Here, the seed crystal, which was produced by cutting the crystal of the composition of $Nd_{1.8}Ba_{2.4}Cu_{3.4}O_x$ including 0.5 wt % of Pt without including Ag that was previously produced by, the melting method to be 2 mm long and wide and 1 mm thick, was brought into contact with the center of the top portion of the precursor so that the growth direction was in parallel with the c-axis. The temperature of the top portion was reduced at the speed of 1° C./hr from 1025° C. to 1015° C. After the precursor was kept at this temperature for 100 hours, it was gradually cooled to 945° C. for the time period of 70 hours, and thereafter, the bottom portion of the precursor was cooled to 945° C. for the time period of 20 hours so that the temperature gradient from the top to the bottom became 0° C./cm. Thereafter, the precursor was gradually cooled to the room temperature for the time period of 100 hours, thereby performing crystallization of the precursor, and the crystal sample of the oxide superconductor was obtained.

When the crystal sample of this oxide superconductor was cut in the vicinity of the center in the up-and-down direction and the section was observed with the EPMA, the $Sm_{2+r}Ba_{1+s}(Cu_{1-d}Ag_d)O_{5-y}$ phases of about 0.1 to 30 μm were microscopically dispersed in the $Sm_{1+p}Ba_{2+q}(Cu_{1-b}Ag_b)_3O_{7-x}$ phase. Here, each of p, q, r, s, and y had the value of −0.2 to 0.2, and x had the value of −0.2 to 0.6. Each of b and d had the value of 0.0 to 0.05, and the average was about 0.008. Ag of about 0.1 to 100 μm dispersed microscopically over the entire crystal specimen. The holes of the size of 5 to 200 μm dispersed under the portion at the 1 mm from the surface. The entire crystal sample reflected the seed crystal, and was oriented uniformly so that the thickness direction of the disc-shaped material was in parallel with the c-axis, the deviation of the orientation between the adjacent crystals was 3 degrees or less, and thus the substantially single-crystal crystal sample was obtained. When the portion under the 1 mm from the surface of this crystal sample was cut out and the density was measured, it was 6.87 g/cm$^3$ (91.2% of the theoretical density of 7.53 g/cm$^3$).

The columnar oxide superconductor of 5 mm wide, 3 mm thick and 90 mm long was cut out from the portion under the 1 mm from the surface of the obtained crystal sample, so that the lengthwise direction was in parallel with the ab plane of the crystal. The additional columnar sample of 3 mm×3 mm×20 mm (note that either one of the 3 mm directions was in the c-axis direction of the crystal) was cut out of this sample, and when the temperature dependency of the thermal conductivity after the annealing treatment was measured, it was about 113 mW/cmK in the integration average value from the temperature of 77K to 10K, which was the low value irrespective of inclusion of 15 wt % of silver.

2) Silver Coat Placement to the Columnar Oxide Superconductor

First, the organic vehicle prepared by mixing 10 wt % of ethyl cellulose, 30 wt % of terpineol, 50 wt % of dibutyl phthalate, and 10 wt % of butyl Carbitol acetate, and Ag powder of the average grain size of 3 μm were mixed in proportions of 3:7 in the weight ratio, and phosphate ester was added by 2%, whereby the Ag paste was prepared.

After the prepared Ag paste with thickness of 50 μm was coated on the both end portions of 10 mm of the columnar oxide superconductor produced in 1), and coated on the positions at 15 mm from the left and right end portions with the width of 2 mm, and the vacuum impregnation treatment was performed, it was dried in the oven at 80° C. in the air. Next, the columnar oxide superconductor coated with the Ag paste was calcined in the furnace body at 920° C. for 10 hours to bake Ag to be the silver coat, and the silver coat oxide superconductor was produced. The film thickness of Ag after baking was about 30 μm.

3) Annealing Treatment of the Silver Coat Oxide Superconductor

The silver coat oxide superconductor was placed in another furnace capable of gas replacement, and after the inside of the furnace was evacuated with the rotary pump to 0.1 Torr, an oxygen gas was fed into the furnace to provide the atmosphere at the atmospheric pressure with the oxygen partial pressure being 99% or higher. Thereafter, while an oxygen gas was fed into the furnace at the flow rate of 0.5 L/min the temperature was raised to 450° C. from the room temperature in 10 hours, then it was gradually cooled from 450° C. to 250° C. for the time period of 400 hours, and was further reduced to the room temperature from 250° C. in 10 hours, whereby the annealing treatment of the silver coat superconductor was performed.

4) Production of the Metallic Electrodes and the Drift Current Restraining Members The metallic electrodes and the drift current restraining members were produced by working the oxygen-free copper of the purity of 4N, and Sn plating was applied to each surface. Each of the metallic electrodes had the lead wire joining portion and the placement portion (oxide superconductor placement portion), and the bolt holes were at two spots in the lead wire joining portion, and the support portion for enhancing the joining strength of the covering member was provided on the opposing surface of the placement portion. Expecting the placement of the oxide superconductor and the charging of the joining metal, the drift current restraining member was in the shape which was made by performing the cutting work by 3.5 mm in the height direction, and 0.5 mm in the width direction from the size of the placement groove provided in the metallic electrode.

5) Placement of the Oxide Superconductor to the Metallic Electrodes

Cerasolzer 143 (hereinafter, described as Cerasolzer), which is the PbSn based solder, was melted and coated onto the placement grooves of the metallic electrodes as the joining metal, into which the oxide superconductor with melt-coating of Cerasolzer being applied to the end portions 10 mm on which Ag was baked was placed, and heated to be temporarily fixed. When the temporary fixing is completed, the heat-resisting silicon rubber was provided as the sealing member from the outer periphery of the oxide superconductor to the outer edge portion of the placement groove to perform the treatment for preventing the outflow of the Cerasolzer.

6) Degassing Treatment of the Joining Metal

After the outflow prevention treatment was completed, the metallic electrodes were heated at 180° C., which is higher than the melting point (143° C.) of the Cerasolzer, to melt the Cerasolzer sufficiently, and they were quickly put into the vacuum container to perform degassing at about 100 Pa for two minutes. Next, the metallic electrodes were heated to 180° C. again, and the drift current restraining members, on which the melt coating of the Cerasolzer was previously applied, were applied to the metallic electrodes, and they were put into the vacuum container again to perform degassing at about 100 Pa for two minutes. Subsequently, the mechanical impact was applied via the drift current restraining member by the ultrasonic soldering iron, and the existing holes in the Cerasolzer were ruptured.

As a result of this, the metallic electrodes, the oxide superconductor, and the drift current restraining members were joined in the electrically and mechanically preferable state with the joining metal without including the holes. When the joining was completed, the sealing members were removed. In this example, in order to measure the characteristics of the produced current lead, the stainless steel lead wire with the diameter of 0.1 mm for characteristics measurement was connected to the portion on which Ag was baked, which was at the position of 15 to 17 mm from the end of the oxide superconductor by using the Cerasolzer.

7) Placement of the Covering Member

The adhesive of the thermosetting epoxy resin composed of bisphenol A-type epoxy resin and aromatic amine was prepared, and vacuum-impregnated to the glass cloth fibers and the chopped glass fibers, to be the pre-preg of the GFRP. Next, the oxide superconductor was placed in the mold so that only the oxide superconductor portion was covered with the GFRP in the oxide superconductor with the aforesaid copper electrodes being joined to the both ends. First, the pre-preg of the glass cloth fivers was placed along the inner wall inside the mold, and after the pre-preg of the chopped glass fibers was charged into the mold space around the oxide superconductor next, and the oxide superconductor was covered with the pre-preg of the glass cloth fibers, it was thermally set at 120° C., whereby the oxide superconductor current lead sample covered with the glass fibers was produced.

8) Evaluation of the Characteristics of the Current Lead

The bus-bars were connected to the lead wire joining portions of the metallic electrodes in the produced current lead sample, then the metallic electrodes and the oxide superconductor were cooled to 77 K, and a current of 1060 A was passed between the both electrodes. When voltage between the metallic electrodes and the characteristics measuring stainless steel wires connected to the positions of 15 to 17 mm from the end portions of the oxide superconductor were measured while the current was being passed, and the contact resistance values between the metallic electrodes and the oxide superconductor were calculated, it was revealed that the contact resistance values at both sides of the current lead sample were 0.19 μΩ, which was very low value.

When the current lead sample was further cooled to 4.2 K, and the contact resistance values between the metallic electrodes and the oxide superconductor were calculated, it was revealed that the contact resistance values at both sides were 0.03 μΩ, which was very low value. The penetrating heat amount by heat transfer to the low temperature side when the low temperature side of this current lead sample was cooled to 4.2 K, and the high temperature side was cooled to 77 K was 0.28 W. Meanwhile, when the critical current value of the current lead sample at 77K in the magnetic field of 0.5 T was measured by passing the current up to 2000 A, it was revealed that the resistance did not occur, and the critical current value was 2000 A or more. Thus, when the effective sectional area was reduced by grinding the section of the superconductor sample by about 0.7 mm in width from 3 mm×5 mm to ϕ 1.9 mm, and the current passage test was conducted again, the critical current value was 670 A. If this result is converted into 3 mm×5 mm in the current lead sample, the value corresponds to about 3500 A in the magnetic field of 0.5 T.

From the above, it was revealed that when the current of 1000 A is passed in the magnetic field of 0.5 T with one of the metallic electrodes being set as the high temperature side (77K) and the other one being set as the low temperature side (4.2 K) in the current lead sample, heat generation amount at the low temperature side was 0.31 W in total, which was a very low value.

Finally, the joint portions at the both sides of the current lead sample were cut, and what percentage of the volumetric capacity of the joint portion the volume of the holes in the joining metal placed at each of the joint portions constituted was measured. As a result, it was revealed that the volume of the holes constituted 0.07% of the volumetric capacity of the joint portion at one side, and it constituted 0.08 thereof at the other side.

EXAMPLE 2

1) Production of the Columnar Oxide Superconductor

Each raw material powder of $Gd_2O_3$, $BaCO_3$, and CuO was weighed so that Gd:Ba: Cu=1:2:3 in the mole ratio and mixed, then calcined at 920° C. for 30 hours, thereafter ground into the average grain size of 3 μm with use of the pot mill, and calcined again at 930° C. for 30 hours and ground into the average grain size of 10 μm in the mixing and grinding machine and the pot mill, whereby the powder of $Gd_1Ba_2Cu_3O_{7-x}$, that was the first calcined powder was prepared. Next, the aforesaid each raw material powder was weighed so that Gd: Ba: Cu=2:1:1 and mixed, then calcined at 890° C. for 20 hours, and ground into the average grain size of 0.7 μm with use of the pot mill, whereby the powder of $Gd_2BaCuO_5$ which was the second calcined powder was prepared.

The first and the second calcined powders were weighed so that $Gd_1Ba_2Cu_3O_{7-x}$: $Gd_2BaCuO_5$=1:0.4, and Pt powder (average grain size 0.01 μm) and $Ag_2O$ powder (average grain size 13.8 μm) were further added and mixed to prepare synthetic powder. However, the Pt content was 0.42 wt % and the Ag content was 15 wt %.

This synthetic powder was press-molded into the plate-shape which was 22 mm long, 120 mm wide and 26 mm thick by using the mold, and thereby the precursor was prepared. Then, this precursor was placed in the furnace and the following process steps were performed.

First, the temperature was raised from the room temperature to 1100° C. in 70 hours, and after the precursor was kept at this temperature for 20 minutes and brought into the semi-molten state, the temperature gradient of 5° C./cm was applied from the top to the bottom of the precursor so that the top portion of the precursor was at the low temperature side, and the temperature was reduced at 0.4° C./min until the temperature of the top portion became 995° C.

Here, the seed crystal, which was produced by cutting the seed crystal of the composition of $Nd_{1.8}Ba_{2.4}Cu_{3.4}O_x$ including 0.5 wt % of Pt without including Ag that was previously prepared by the melting method to be 2 mm long and wide and 1 mm thick, was brought into contact with the center of the top portion of the precursor so that the growth direction was in parallel with the c-axis. The temperature of the top portion was reduced at the speed of 1° C./hr from 995° C. to 985° C. After the precursor was kept at this temperature for 0.100 hours, it was gradually cooled to 915° C. for the time period of 70 hours, and thereafter, the bottom portion of the precursor was cooled to 915°° C. for the time period of 20 hours so that the temperature gradient from the top to the bottom became 0° C./cm. Thereafter, the precursor was gradually cooled to the room temperature for the time period of 100 hours, thereby performing crystallization of the precursor, and the crystal sample of the oxide superconductor was obtained.

When the crystal sample of this oxide superconductor was cut in the vicinity of the center in the up-and-down direction and the section was observed with the EPMA, the $Gd_{2+r}Ba_{1+s}(Cu_{1-d}Ag_d)O_{5-y}$ phases of 0.1 to 30 μm were microscopically dispersed in the $Gd_{1+p}Ba_{2+q}(Cu_{1-b}Ag_b)_3O_{7-x}$ phase. Here, each of p, q, r, s, and y had the value of −0.2 to 0.2, and x had the value of −0.2 to 0.6. Each of b and d had the value of 0.0 to 0.05, and the average was about 0.008. Ag of about 0.1 to 100 μm dispersed microscopically over the entire crystal sample. The holes of the size of about. 5 to 200 μm dispersed under the portion at the 1 mm from the surface. The entire crystal sample reflected the seed crystal, and was oriented uniformly so that the thickness direction of the disc-shaped material was in parallel with the c-axis, the deviation of the orientation between the adjacent crystals was 3 degrees or less, and thus the crystal sample in the substantially single-crystal form was obtained. When the portion under the 1 mm from the surface of this crystal sample was cut out and the density was measured, it was 7.0 g/cm$^3$ (91.1% of the theoretical density of 7.68 g/cm$^3$).

The columnar oxide superconductor of 5 mm wide, 3 mm thick and 105 mm long was cut out from the portion under the 1 mm from the surface of the obtained crystal sample, so that the lengthwise direction was in parallel with the ab plane of the crystal. The additional columnar sample of 3 mm×3 mm×20 mm (note that either one in the 3 mm directions was in the c-axis direction of the crystal) was cut out of this sample, and when the temperature dependency of the thermal conductivity after the annealing treatment was measured, it was about 141 mW/cmK in the integration average value from the temperature of 77K to 10K, which was the low value irrespective of inclusion of 15 wt % of silver.

Thereinafter,

2) Silver coat placement to the columnar oxide superconductor

3) Annealing treatment of the silver coat oxide superconductor

4) Production of the metallic electrodes and the drift current restraining members 5) Placement of the oxide superconductor into the metallic electrodes 6) Degassing treatment of the joining metal 7) Placement of the covering member 8) Evaluation of the characteristics of the current lead were performed similarly to the example 1, and the following results were obtained.

First, when the contact resistance values of the joint portions of the metallic electrodes and the oxide superconductor at the both ends of the current lead sample were calculated, it was revealed that the one was 0.2μΩ, and the other was 0.21μΩ, which were the very low values.

When the current lead sample was further cooled to 4.2 K, and the contact resistance values between the metallic electrodes and the oxide superconductor were calculated, it was revealed that the contact resistance values at the both sides were 0.03 μΩ, which was the very low value.

The penetrating heat amount by heat transfer to the low temperature side when the low temperature side of this current lead sample was cooled to 4.2K, and the high temperature side was cooled to 77K was 0.33 W.

Meanwhile, when the critical current value of the current lead sample at 77K in the magnetic field of 0.5 T was measured by passing the current up to 2000 A, it was revealed that the resistance did not occur, and the critical current value was 2000 A or more. Thus, when the effective sectional area was reduced by grinding the section of the superconductor sample by 0.7 mm in width from 3 mm×5 mm to ϕ 1.9 mm, and the current passage test was conducted again, the critical current value was 530 A. If this result is converted into 3 mm×5 mm in the current lead sample, the value corresponds to about 2800 A in the magnetic field of 0.5 T.

From the above, it was revealed that when the current of 1000 A was passed in the magnetic field of 0.5 T with one of the metallic electrodes being as the high temperature side (77 K) and the other one being as the low temperature side (4.2 K) in the current lead sample, the heat generation amount at the low temperature side was 0.36 W in total, which was the very low value.

Finally, the joint portions at the both sides of the current lead sample were cut, and what percentage of the volumetric capacity of the joint portion the volume of the holes in the joining metal placed at each of the joint portions constituted was measured. As a result, it was revealed that the both constituted about 0.1% of the volumetric capacity of the joint portion.

EXAMPLE 3

1) Production of the Columnar Oxide Superconductor

Each raw material powder of $Sm_2O_3$, $BaCO_3$, and CuO was weighed so that Sm:Ba:Cu=1:2:3 in the mole ratio and mixed, then calcined at 920° C. for 30 hours, thereafter ground into the average grain size of 3 μm with use of the pot mill, and calcined again at 930° C. for 30 hours and ground into the average grain size of 10 μm in the mixing and grinding machine, and the pot mill, whereby the powder of $Sm_1Ba_2Cu_3O_{7-x}$ that was the first calcined powder was prepared.

Next, the aforesaid each raw material powder was weighed so that Sm:Ba:Cu=2:1:1 and mixed, then calcined at 890° C. for 20 hours, and ground into the average grain size of 0.7 μm with use of the pot mill, whereby the powder of $Sm_2BaCuO_5$, which was the second calcined powder, was prepared.

The first and the second calcined powders were weighed so that $Sm_1Ba_2Cu_3O_{7-x}$ $Sm_2BaCuO_5$=1:0.4, and Pt powder (average grain size 0.01 μm) and $Ag_2O$ powder (average grain size 13.8 μm) were added and mixed to prepare the synthetic powder A. Similarly, the first and the second calcined powders were weighed so as to be 1:0.3, and Pt powder and $Ag_2O$ powder were added and mixed to prepare the synthetic powder B. It should be noted that the Pt content was 0.42 wt % and the Ag content was 10 wt % for both the synthetic powders A and B.

These two kinds of synthetic powders A and B were each press-molded into the plate-shape which was 22 mm long, 120 mm wide and 26 mm thick by using the mold, and thereby the precursor A using the synthetic powder A, and the precursor B using the synthetic powder B were produced. Then, these precursors A and B were placed in the furnace and the following process steps were performed.

First, the temperature was raised from the room temperature to 1100° C. in 70 hours, and after the precursors were kept at this temperature for 20 minutes and brought into the semi-molten state, the temperature gradient of 5° C./cm was applied from the top to the bottom of the precursors so that the top portions of the precursors were at the low temperature side, and the temperature was reduced at 0.4° C./min until the temperature of the top portions became 995° C.

Here, the seed crystal, which was produced by cutting the seed crystal of the composition of $Nd_{1.8}Ba_{2.4}Cu_{3.4}O_x$ including 0.5 wt % of Pt without including Ag, which was previously prepared by the melting method, to be 2 mm long and wide and 1 mm thick, was brought into contact with the center of the top portion of each of the precursors so that the growth direction was in parallel with the c-axis. The temperature of the top portions was reduced at the speed of 1° C./hr from 995° C. to 985° C. After the precursors were kept at this temperature for 100 hours, they were gradually cooled to 915° C. for the time period of 70 hours, and thereafter, the bottom portions of the precursors were cooled to 915° C. in 20 hours so that the temperature gradient from the top to the bottom became 0° C./cm. Thereafter, the precursors were gradually cooled to the room temperature for the time period of 100 hours, thereby performing crystallization of the precursors, and the crystal sample A of the oxide superconductor was obtained from the precursor A, while the crystal sample B of the oxide superconductor was obtained from the precursor B.

When the crystal samples A and B of this oxide superconductor were each cut in the vicinity of the center in the up-and-down direction and the sections were observed with the EPMA, in each of them, the $Sm_{2+r}Ba_{1+s}(Cu_{1-d}Ag_d)O_{5-y}$ phases of 0.1 to 30 μm were microscopically dispersed in the $Sm_{1+p}Ba_{2+q}(Cu_{1-b}Ag_b)_3O_{7-x}$ phase. Here, each of p, q, r, s, and y had the value of −0.2 to 0.2, and x had the value of −0.2 to 0.6. Each of b and d had the value of 0.0 to 0.05, and the average was about 0.008. Ag of about 0.1 to 100 μm dispersed microscopically over the entire crystal samples. The holes of the size of about 5 to 200 μm dispersed under the portions at the 1 mm from the surfaces. The entire crystal samples reflected the seed crystal, and each was oriented uniformly so that the thickness direction of the disc-shaped material was in parallel with the c-axis, the deviation of the orientation between the adjacent crystals was 3 degrees or less, and thus the crystal samples A and B each in the substantially single-crystal form were obtained. When the portions under the 1 mm from the surfaces of these crystal samples A and B were cut out and the densities were measured, the density was 6.7 g/cm$^3$ (90.8% of the theoretical density of 7.38 g/cm$^3$) in the crystal A produced with the composition of 1:0.4, and it was 6.7 g/cm$^3$ (91.2% of the theoretical density of 7.35 g/cm$^3$) in the crystal B produced with the composition of 1:0.3.

The columnar oxide superconductors A and B of 3 mm wide, 3 mm thick and 90 mm long were cut out from the portions under the 1 mm from the surfaces of the obtained crystal samples A and B, so that the lengthwise direction was in parallel with the ab plane of the crystal.

The additional columnar samples each of 3 mm×3 mm×20 mm (note that either one in the 3 mm directions was in the c-axis direction of the crystal) were cut out of these samples, and when the temperature dependencies of the thermal conductivity after the annealing treatment were measured, the temperature dependency of A was about 62.1 mW/cmK, while that of B was about 62.9 mW/cmK, both in the integration average value from the temperature of 77 K to 10 K, and these values were low values irrespective of inclusion of 10 wt % of silver.

Thereinafter,

2) Silver coat placement to the columnar oxide superconductors A and B

3) Annealing treatment of the silver coat oxide superconductors. A and B

4) Production of the metallic electrodes and the drift current restraining members 5) Placement of the oxide superconductors A and B into the metallic electrodes 6) Degassing treatment of the joining metal 7) Placement of the covering member were performed similarly to the example 1, and the current lead A using the oxide superconductor A, and the current lead B using the oxide superconductor B were obtained.

8) Evaluation of the characteristics of the current leads A and B

The electrical characteristics of the obtained current leads A and B were measure as in the example 1, and the following results were obtained.

First, when the contact resistance values of the joint portions of the metallic electrodes and the oxide superconductor at the both ends of the current lead A were calculated, it was revealed that the one was 0.28 μΩ, and the other was 0.29 μΩ, which were very low values, and similarly in the joint portions of the current lead B, it was revealed that one was 0.30μΩ, and the other was 0.29 μΩ, which were very low values.

When the current leads A and B were further cooled to 4.2 K, and the contact resistance values between the metallic electrodes and the oxide superconductors were calculated, it was revealed that the contact resistance values at the both sides of both A and B were 0.05 μΩ, which was a very low value.

The penetrating heat amount by heat transfer to the low temperature side when the low temperature side of each of these current lead samples was cooled to 4.2K, and the high temperature side was cooled to 77 K was about 0.15 W in the both A and B.

Meanwhile, when the critical current values of the current lead samples at 77 K were 1300 A in the A and 1500 A in the B in the magnetic field of 0.5 T.

From the above, it was revealed that when the current of 1000 A was passed in the magnetic field of 0.5 T with one of the metallic electrodes being as the high temperature side (77 K) and the other one being as the low temperature side (4.2 K) in each of the current lead samples, the heat generation amount at the low temperature side was 0.2 W in total, which was a very low value.

Finally, the joint portions at the both sides of the current leads A and B were cut, and what percentage of the volumetric capacity of the joint portion the volume of the holes in the joining metal placed at each of the joint portions constituted was measured. As a result, it was revealed that in the current lead A, it constituted 0.06% at the one side and 0.07% at the other side, and in the current lead B, it constituted 0.07% at the one side and 0.08% at the other side.

EXAMPLE 4

The oxide superconductor current lead sample was produced similarly to the example 1 except for that the temperature of 6) the degassing treatment of the joining metal in the example 1 was set at 160° C.

When the contact resistance values of the joint portions of the metallic electrodes and the oxide superconductor at the both sides of the current lead sample were calculated as in the example 1, it was revealed that the one was 0.3 μΩ, and the other was 0.27 μΩ, which were very low values.

When the current lead sample was further cooled to 4.2 K, and the contact resistance values between the metallic electrodes and the oxide superconductor were calculated, it was revealed that the contact resistance values at the both sides were 0.05 μΩ, which was a very low value.

Meanwhile, the critical current value and the penetrating heat at 77 K in the magnetic field of 0.5 T were substantially at the same levels as in the example 1.

From the above, it was revealed that when the current of 1000 A was passed in the magnetic field of 0.5 T with one of the metallic electrodes as the high temperature side (77 K) and the other one as the low temperature side (4.2 K) in the current lead sample, the heat generation amount at the low temperature side was about 0.38 W in total, which was a very low value.

Finally, the joint portions at the both sides of the current lead sample were cut, and what percentage of the volumetric capacity of the joint portion the volume of the holes in the joining metal placed at each of the joint portions constituted was measured. As a result, it was revealed that it constituted 5% of the volumetric capacity of the joint portion at the one side and it constituted 4% thereof at the other side.

COMPARISON EXAMPLE

This is similar to the example 2, but each of the current leads was produced with the set temperature of the ultrasonic soldering iron being set at 160° C. and 180° C., without performing the process step of "6) Degassing treatment of the joining metal", and "8) Evaluation of the characteristics of the current leads" was performed.

First, concerning the sample joined at the setting of 160° C., the contact resistance values of the joint portions of the metallic electrodes and the oxide superconductor at the both sides of the current lead sample were calculated, it was revealed that they were 0.8 μΩ at one side, and 0.9 μΩ at the other side, which were large in the absolute value, and variations in the contact resistance value were large.

In the sample joined at the setting of 180° C., outflow of the joining metal was large, and when the contact resistance values were calculated, it was revealed that they were 1.2 μΩ at the one side, and 1.1 μΩ at the other side, which were large in the absolute value, and the variations of the contact resistance value were large.

Finally, the joint portions at the both sides of the current lead samples were cut, and what percentage of the volumetric capacity of the joint portion the volume of the holes in the joining metal placed at each of the joint portions constituted was measured. As a result, it was revealed that it constituted 30% of the volumetric capacity of the joint portion at the one side and it constituted 35% thereof at the other side in the sample joined at the setting of 160° C., and in the sample joined at the setting of 180° C., it constituted 50% of the volumetric capacity of the joint portion at one side and it constituted 45% thereof at the other side.

The list of the treatment conditions and the evaluation results of the examples 1 to 4 and the comparison example 1 which are explained thus far is shown in FIG. 7. In FIG. 7, one of the joint portions of the metallic electrodes and the oxide superconductor at the both sides of each of the current lead samples was described "right" and the other one was described "left" for convenience.

Second Embodiment

Hereinafter, a second embodiment of the present invention will be explained with reference to the drawings.

The inventors has made the hypothesis that if the potential difference along the interfaces of the metallic electrode portions can be decreased by placing the oxide superconductor in the metallic electrodes of the oxide super conductor current lead so as to be in substantially parallel with the interfaces with the aforesaid mating conductors, occurrence of the drift current can be restrained macroscopically, even when variations in the contact resistance microscopically exist in the interface portions of the mating conductors and the metallic electrodes, and as a result, the contact resistance values in these portions can be reduced. When the inventors produced the oxide superconductor current lead according to this hypothesis, they have found out that the contact resistance values in the interface portions of the mating conductors and themetallic electrodes can be reduced.

Hereinafter, the second embodiment of the present invention will be explained with reference to the drawings.

First, with reference to FIGS. 9A, 9B and 9C to FIG. 14, an oxide superconductor current lead according to the present invention will be explained in detail.

Figure 9A:
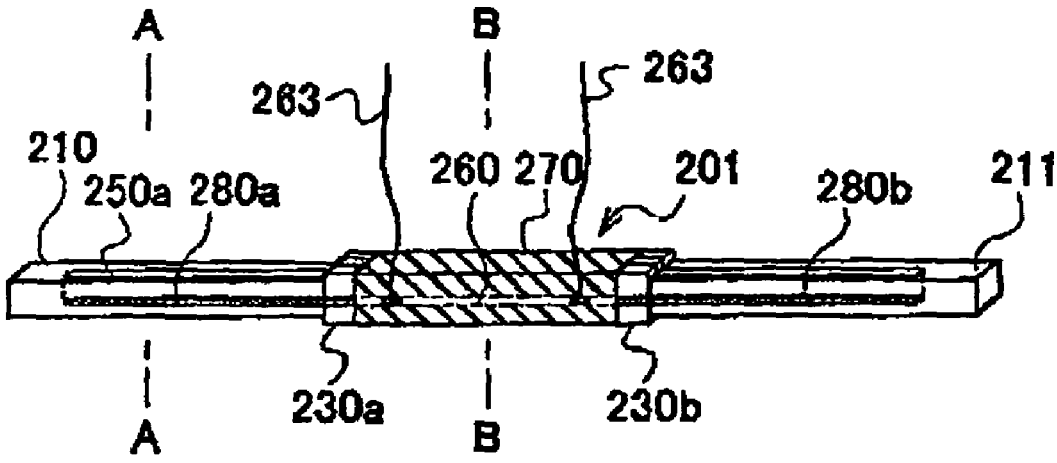
FIG. 9A is a perspective view of an external appearance of an oxide superconductor current lead main body according to the present invention.
Figure 9B:
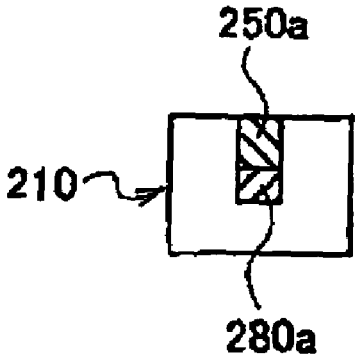
FIG. 9B is a sectional view taken along the line A to A.
Figure 9C:
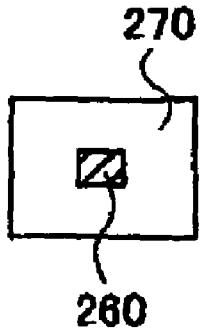
FIG. 9C is a sectional view taken along the line B to B.
Figure 10:
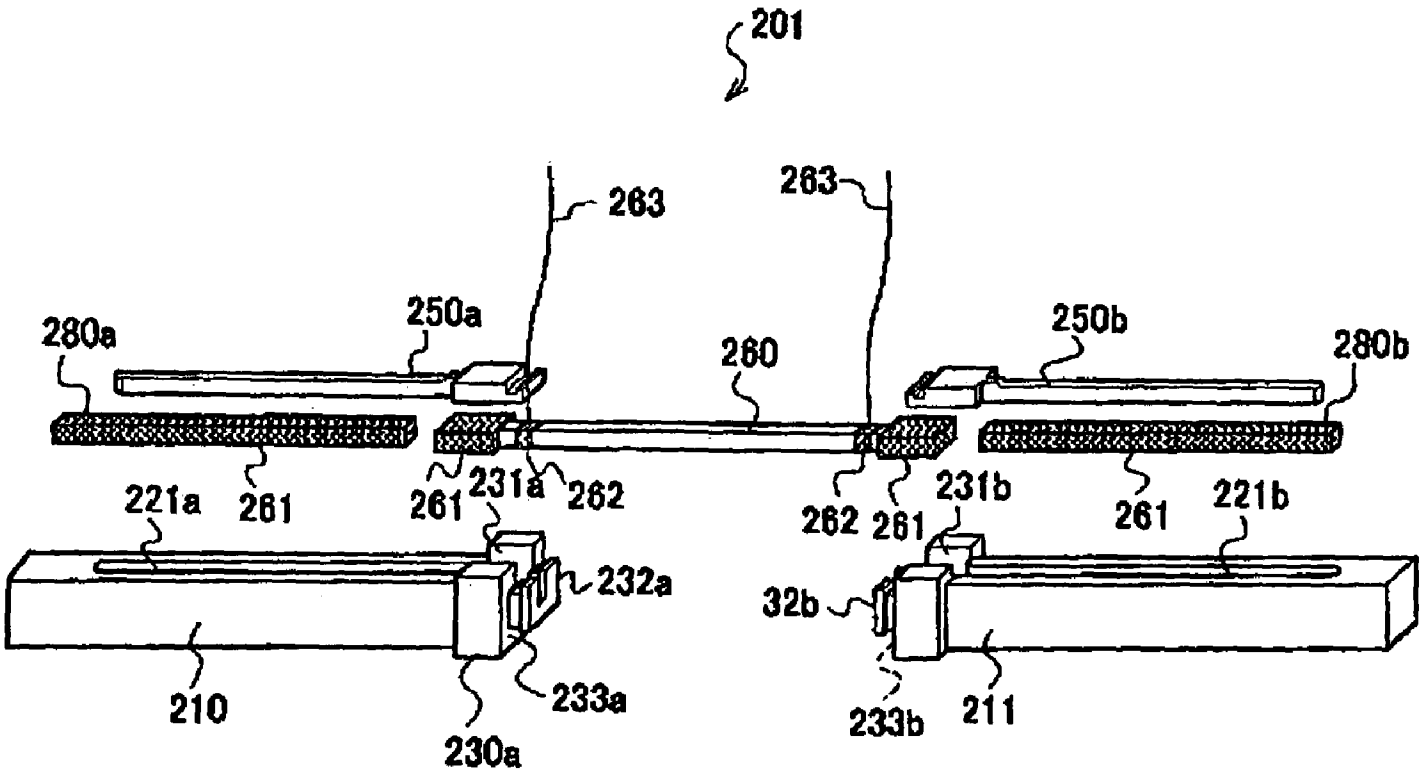
FIG. 10 is an exploded perspective view of the oxide superconductor current lead shown in FIGS. 9A, 9B and 9C.
Figure 11:
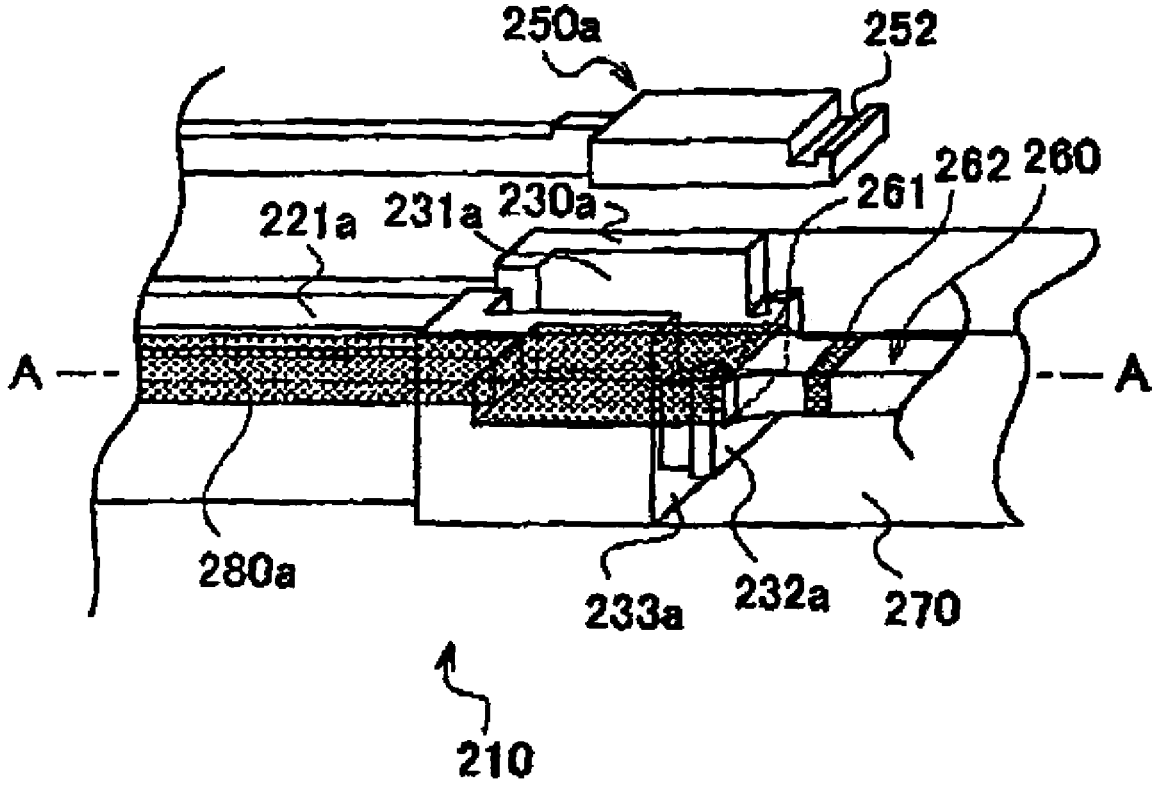
FIG. 11 is an enlarge exploded perspective view of a joint portion of the oxide superconductor current lead according to the present invention.
Figure 12:
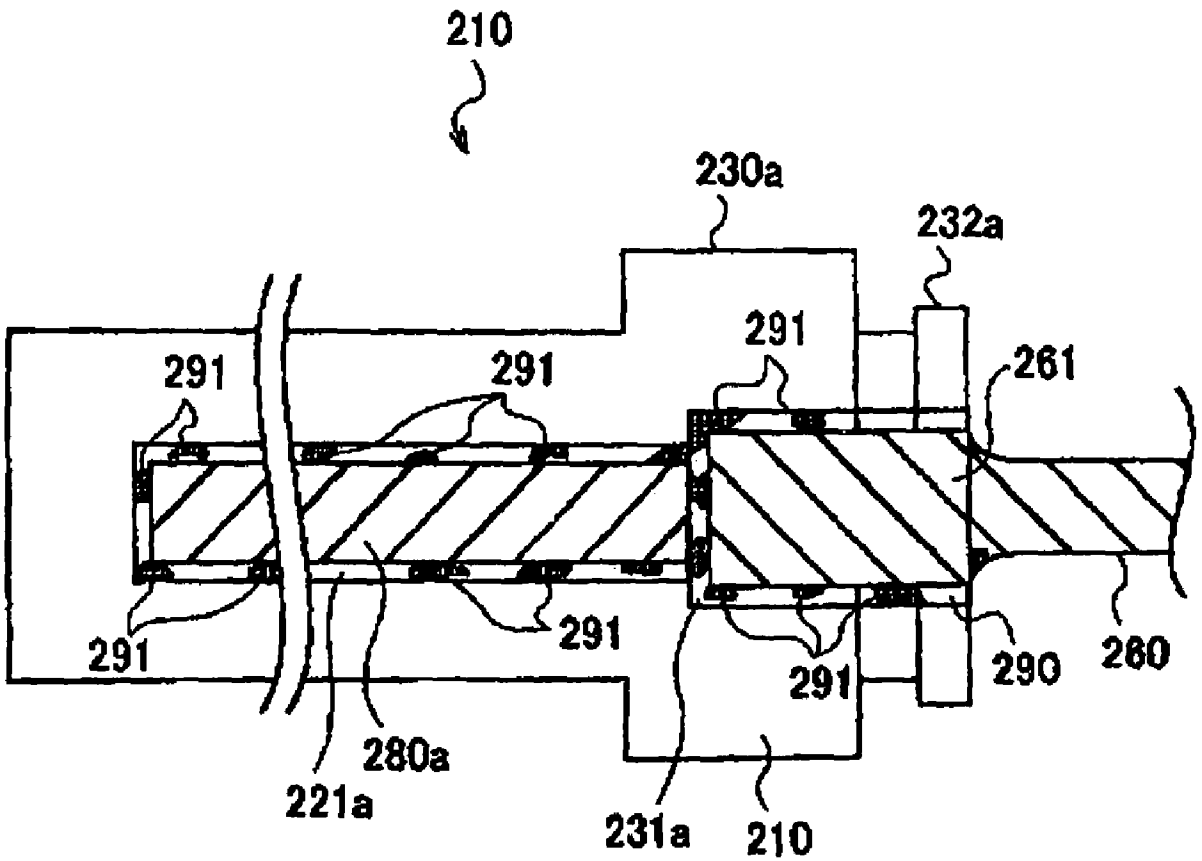
FIG. 12 is a sectional view taken along the line A to A of FIG. 11.

FIG. 9A is an external perspective view of the oxide superconductor current lead main body according to the present invention, FIG. 9B is a sectional view taken along the line A to A in FIG. 9A, and FIG. 9C is a sectional view taken along the line B to B in FIG. 9A. FIG. 10 is an exploded perspective view of the oxide superconductor current lead main body in FIGS. 9A, 9B and 9C is further exploded into each part, FIG. 11 is an enlarged exploded perspective view of the joint portion of the electrode and the oxide superconductor in FIG. 10, and FIG. 12 is a sectional view taken along the line A to A.

In FIG. 9A, a current lead 201 has a substantially square pillar shape, and is constituted of three parts which are a power supply side metallic electrode 210, an interelectrode oxide superconductor (hereinafter, described as the interelectrode superconductor) 260 and a system side metallic electrode 211, and the power supply side metallic electrode 210 and the system side metallic electrode 211 have the same constitution.

First, a columnar in-electrode oxide superconductor (hereinafter, described as the in-electrode superconductor) 280*a* is placed in the power supply side metallic electrode 210, and a drift current restraining member 250*a* is covered thereon. This state is shown in FIG. 9B.

Returning to FIG. 9A here, the in-electrode superconductor 280*a* advances to the right in the drawing in the power supply side metallic electrode 210, and reaches a placement portion 230*a* which is a right end portion of the power supply side metallic electrode 210. The in-electrode superconductor 280*a* terminates here, and joins to the interelectrode superconductor 260. This joining will be described later.

The interelectrode superconductor 260 joined to the in-electrode superconductor 280*a* separates from the power supply side metallic electrode 210 via the inside of the placement portion 230*a*, then is covered with a covering member 270, reaches the system side metallic electrode 211, and reaches the inside of the system side metallic electrode 211 via the placement portion 230*b*. The state of the interelectrode superconductor 260 covered with the covering member 270 is shown in FIG. 9C.

The interelectrode superconductor 260, which reaches the inside of the system side metallic electrode 211, advances in the placement portion 230*b*, and is joined to the in-electrode superconductor 280*b* at its terminal end. As described above, the portion from the placement portion 230*b* has the same constitution as the power supply side metallic electrode 210.

Two measuring conductors 263 joined to the interelectrode superconductor 260, are used to evaluate the characteristics of the current lead 201 which will be described later in the examples.

FIG. 10 is a perspective view when the current lead 201 shown in FIGS. 9A, 9B and 9C is exploded into each component.

First, as shown in FIG. 10, the metallic electrodes 210 and 211 at the power supply side and the system side have the substantially square pillar shapes, and on their top surfaces, in-electrode oxide superconductor embedding grooves (hereinafter, described as the in-electrode embedding grooves) 221*a* and 221*b* in which the in-electrode oxide superconductors 280*a* and 280*b* are placed, and interelectrode oxide superconductor embedding grooves (hereinafter, described as the interelectrode embedding grooves) 231*a* and 231*b* in which end portions of the interelectrode superconductor 260 are placed are continuously engraved. In this embodiment, the metallic electrodes 210 and 211 at the power supply side and the system side have the same constitutions, and therefore the power supply side metallic electrode 210 will be explained as an example, hereinafter.

The interelectrode embedding groove 231*a* is engraved at a right side, facing to the drawing, of the power supply side metallic electrode 210, and since an end portion of the interelectrode superconductor 260 is expanded in width as will be described later, the interelectrode embedding groove 231*a* is correspondingly expanded in width more than the in-electrode embedding groove 221*a*, and the power supply side metallic electrode 210 is also expanded in width at this portion to be a placement portion 230*a*. Further, in an opposing surface 233*a* where the interelectrode superconductor 260 protrudes from the power supply side metallic electrode 210, a portion supporting the interelectrode superconductor 260 protrudes from the opposing surface 233*a* to be a support portion 232*a*.

It is preferable that the metallic electrodes 210 and 211 at the power supply side and the system side are previously provided with plating with the element or alloy of tin, silver, gold, nickel, zinc, or palladium as a main component, or a layered body of the aforesaid plating in order to enhance wettability with joining metal (not shown) which will be described later, and which is used to join these electrodes and the oxide superconductor, and to reduce the contact resistance values with a conductor drawn from the power supply side and a conductor drawn from the system side.

Meanwhile, the oxide superconductor used for the current lead 201 is constituted of three parts which are the in-electrode superconductor 280*a*, the interelectrode superconductor 260 and the in-electrode superconductor 280*b* from the left facing to the drawing.

Here, it is preferable to use a rare-earth based oxide superconductor produced by the melting method, which is capable of passing a large current even with a small sectional area, for the interelectrode superconductor 260. This is because heat penetration to a cryogenic superconducting magnet can be further reduced by reducing the sectional area of the interelectrode superconductor 260.

On the other hand, it is difficult to produce a long length of rare-earth based oxide superconductor produced by the melting method. Consequently, when the substantially left end of the power supply side metallic electrode 210 and the substantially right end of the system side metallic electrode 211 are connected with an integrated rare-earth based oxide superconductor produced by the melting method, it is sometimes difficult to provide a sufficient space between a high temperature side and a low temperature side. Thus, in order to provide a sufficient space between the high temperature side and the low temperature side, it is preferable to adopt, the constitution in which the oxide superconductor is constituted of a joined body of a plurality of oxide superconductors.

It is further preferable to adopt this constitution because the oxide superconductors in the both metallic electrodes can be extended.

The contact resistance values between the joined oxide superconductors when a plurality of oxide superconductors are joined to form the joined body of the oxide superconductors are about 1/10 to 1/100 as compared with the contact resistance values of the mate conductors and the metallic electrodes, and therefore they do not matter practically.

In the interelectrode superconductor 260, the portions embedded into the placement portions 230*a* and 230*b* of the metallic electrodes 210 and 211 at the power supply side and the system side are expanded in width, an intermediate portion other than them has a pillar shape constricted to be slim, and the both end portions expanded in width are provided with silver coat 261. Here, the reason why the portions to be embedded into the placement portions 230*a* and 230*b* at the power supply side and the system side are expanded in width and are provided with the silver coat 261 in the interelectrode superconductor 260 is to reduce the contact resistance values, and the reason why the intermediate portion has the shape constricted to be slim is to restrain heat transfer. However, the current lead 201 according to the present invention is low in the contact resistance value and low in generating Joule heat, and therefore even if the interelectrode superconductor 260 is in a simple pillar shape, it can sufficiently exhibit the effect.

It is also the preferable constitution to provide measuring silver coat 262 just before the expanded width portions at the both ends and provide measuring conductors 263 thereon, in the interelectrode superconductor 260. On evaluation of the characteristics of the current lead 201, the characteristics of the interelectrode superconductor 260 can be easily grasped by measuring the potential difference of this portion by using the measuring conductors 263 when a desired current is passed between the metallic electrodes 210 and 211 at the power supply side and the system side, and this is also preferable from the viewpoint of the quality control.

Next, there is no special limitation in the shapes of the in-electrode superconductors 280*a* and 280*b*, and therefore those in the pillar shapes at low production cost may be used. There is no special limitation in their material quality, but it is preferable to use rare-earth based oxide superconductors produced by the melting method similar to the interelectrode superconductor 260, because they have high mechanical strength. The contact resistance value of the current lead 201 can be reduced by previously applying silver coat onto entire surfaces of the in-electrode superconductors 280*a* and 280*b*, which is a preferable constitution.

By using the oxide superconductors of the critical temperature of 90 K or more for these interelectrode superconductor 260, in-electrode superconductors 280*a* and 280*b*, the margin of the temperature at the low temperature side of the current lead becomes larger, and the current lead can be applied to the system of the operation temperature of 20 K or more, thus making it possible to increase versatility as the current lead remarkably.

Next, after the oxide superconductor is placed in the in-electrode embedding grooves 221*a* and 221*b* and the interelectrode embedding grooves 231*a* and 231*b*, which are engraved in the metallic electrodes 210 and 211 at the power supply side and the system side, drift current restraining members 250*a* and 250*b* are fitted onto top portions thereof, and they have the structure of being integrated with the both metallic electrodes 210 and 211. It is also preferable that the drift current restraining members 250*a* and 250*b* are previously provided with plating with the element or alloy of tin, silver, gold, nickel, zinc, or palladium as a main component, or a layered body of the aforesaid plating in order to enhance adhesiveness with joining metal which will be described later.

Though illustration is omitted in FIG. 10, a covering member 270 for covering the interelectrode superconductor 260 is provided between the opposing surfaces 233*a* and 233*b* of the metallic electrodes 210 and 211 at the power supply side and the system side, which oppose each other with the interelectrode superconductor 260 sandwiched between them. This covering member 270 mechanically and environmentally protect the interelectrode superconductor 260 by being supported by the support portions 232*a* and 232*b* provided at the opposing surfaces 233*a* and 233*b* and fixed to the both electrodes.

Next, referring to FIG. 11 placement of the interelectrode superconductor 260, the in-electrode superconductors 280*a* and 280*b*, and the drift current restraining members 250*a* and 250*b* into the metallic electrodes 210 and 211 at the power supply side and the system side will be explained, and the side of the power supply side metallic electrode 210 will be explained as an example because both the metallic electrodes 210 and 211 have the same constitutions.

FIG. 11 is an external perspective view of the portion in the vicinity of the placement portion 230*a* provided at the power supply side metallic electrode 210 of the current lead 201 shown in FIGS. 9 and 10. The drift current restraining member 250*a* is in the state in which it is removed for convenience of explanation.

A right end portion of the metallic electrode 210 at the power supply side is thicker than the other portions and forms the placement portion 230*a*, and this corresponds to the expansion in width of the left end portion of the interelectrode superconductor 260 as described above. The in-electrode embedding groove 221*a* and the interelectrode embedding groove 231*a* are engraved in the top surface of the current lead 1, where the entire body of the in-electrode superconductor 280*a* and the left end portion of the interelectrode superconductor 260 are provided, respectively. The support portion 232*a* is provided at the opposing surface 233*a* which is the surface on which the interelectrode superconductor 260 protrudes in' the placement portion 230*a* so as to surround the interelectrode embedding groove 231*a*, and this support portion 232*a* mechanically supports the covering member 270.

Further, in the in-electrode superconductor 280*a* and the interelectrode superconductor 260, the silver coat 261 is provided on surfaces on which they are in contact with each other, surfaces in contact with the metallic electrode 210 at the power supply side, and surfaces in contact with the drift current restraining member 250*a*. Further, in the interelectrode superconductor 260, the aforementioned measuring silver coat 262 for characteristics measurement is provided at the position which is 15 to 17 mm from the support portion 232*a*.

The drift current restraining member 250*a* is placed into the in-electrode embedding groove 221*a* and the interelectrode embedding groove 231*a*, after the oxide superconductor is placed therein. In this situation, the drift current restraining member 250*a* is integrated with the metallic electrode 210 at the power supply side, and for this purpose, a restraining member protruding portion 252 is provided at a right end portion thereof.

When this drift current restraining member 250*a* is placed into the interelectrode embedding groove 231*a* and the in-electrode embedding groove 221*a*, it is preferable that a clearance occurring here is made about 0.05 to 0.5 mm at one side. This is because if this clearance is 0.05 mm or more, degassing of the joining metal sufficiently advances, and if it is 0.5 mm or less, unnecessary rise in the contact resistance value due to increase in the volumetric capacity of the joining metal can be avoided. The clearance between the drift current restraining member 250*a*, and the interelectrode embedding groove 231*a* and the in-electrode embedding groove 221*a* constitute a degassing portion which will be described in FIG. 12.

When the end portion of the interelectrode superconductor 260 and the entire body of the in-electrode superconductor 280*a* are placed in the interelectrode embedding groove 231*a* and the in-electrode embedding groove 221*a*, and the drift current restraining member 250*a* is further placed thereon, the in-electrode superconductor 280*a* and the interelectrode superconductor 260, the interelectrode embedding groove

231*a*, the in-electrode embedding groove 221*a* and the drift current restraining member 250*a* constitute a joint portion which is a portion in which they are in contact with and joined to one another.

In the interelectode superconductor 260, the silver coat 261 is previously applied to five surfaces opposing the interelectrode embedding groove 231*a* and the drift current restraining member 250*a* and constituting the joint portion, from the viewpoint of reducing the contact resistance value at this portion. The silver coat 261 is also previously applied to the entire surface of the in-electrode superconductor 280*a* from the viewpoint of reducing the contact resistance with the interelectrode superconductor 260, the in-electrode embedding groove 221*a* and the drift current restraining member 250*a*. As the method for the silver coat, the coating and baking method of a silver paste material, plating method, vapor deposition method, sputtering method, thermal spraying method and the like are applicable, and therefore any one of them may be properly selected from the viewpoint of productivity, and mass productivity.

From the viewpoint of reducing the aforesaid contact resistance of the in-electrode superconductor 280*a*, the interelectrode superconductor 260, the in-electrode embedding groove 221*a* and the drift current restraining member 250, it is preferable to join them by the joining metal.

In order to join them, melt-coating of the joining metal is applied into the interelectrode embedding groove 231*a* and the in-electrode embedding groove 221*a*, into which the interelectrode superconductor 260 and the in-electrode superconductor 280*a* with melt-coating of the joining metal being applied onto the silver coat are placed, and it is preferable that after the molten joining metal is injected into the joint portion formed by the interelectrode superconductor 260 and the in-electrode superconductor 280*a*, and the interelectrode embedding groove 231*a* and the in-electrode embedding groove 221*a*, as necessary, it is solidified by cooling to join them.

As this joining metal, various kinds of solder having the melting point of 300° C. or lower are preferably used to avoid the oxide superconductor being heated to become rid of oxygen on melt-coating. Among them, from the viewpoint of increase in adhesiveness of the joint portion and reduction in the contact resistance, it is desirable to use Pb—Sn based and In based soldering materials doped with Cd, Zn, Sb and the like so that adhesiveness with ceramics and coating properties are increased, for example. Here, as a preferable example of the soldering material for ceramics, Cerasolzer (trade name) is described.

Cerasolzer 143 made by Asahi Glass Co., Ltd.

Components: Sn: 45 to 51 (Wt %), Pb: 26 to 32, Cd: 16 to 22, Zn: 2 to 4, Sb: 1 to 3

Melting point: 143° C.

Cerasolzer 123 made by Asahi Glass Co., Ltd.

Components: In: 44 to 50 (Wt %), Cd: 0.45 to 50, Zn: 1 to 3, Sb: less than 1

Melting point: 123° C.

The power supply side metallic electrode 210, and the interelectrode superconductor 260 and the in-electrode superconductor 280*a* can be electrically joined all in the state of surface contact by adopting the constitution in which the end portion of the interelectrode superconductor 260 and the entire body of the in-electrode superconductor 280*a* are fitted into the interelectrode embedding groove 231*a* and the in-electrode embedding groove 221*a* provided at the power supply side metallic electrode 210, then the drift current restraining member 250*a* is placed thereon to form the joint portion, in which the joining metal is provided, and thereby the power supply side metallic electrode 210, the interelectrode superconductor 260 and the in-electrode superconductor 280*a* are joined. As a result, it is preferable because the contact resistance value in this portion can be reduced.

Naturally, as the embodiments other than this, it is possible to adopt the embodiment in which the metallic electrode is formed into a cap shape, and the oxide superconductor is fitted into this, or the embodiment in which the metallic electrode has the dividable structure, and the metallic electrode is assembled up in such a form as sandwiching the oxide superconductor, and the structure of the oxide superconductor may be in a circular columnar shape, or a circular cylindrical shape.

However, the inventors of this invention has found out that a gaseous component such as air is taken into the molten joining metal, when melt-coating of the molten joining metal is applied to the interelectrode superconductor 260, the in-electrode superconductor 280*a*, the interelectrode embedding groove 231*a*, and the in-electrode embedding groove 221*a*, and they are further integrated, in the joining with use of this joining metal. The gaseous component taken into the molten joining metal forms holes inside when the joining metal is solidified. If the holes are formed inside the joining metal, the passage of the current flowing between the metallic electrode and the oxide superconductor via the joining metal is narrowed, and when a predetermined current, for example, a large current as 1000 A is passed, this portion becomes the new cause of increase in the contact resistance value.

Another problem of the above-described holes has been found out. Namely, at the time of use of the current lead 201, if the heat history between the room temperature and the liquid helium temperature or the liquid nitrogen temperature is repeated for the oxide superconductor embedded in the system side metallic electrode, stress is applied due to the difference in the linear expansion coefficient between the metallic electrode and the oxide superconductor. In this situation, if the aforementioned holes are formed in the joint portion of the both of them, stress concentrates on this, and a crack occurs to the embedded oxide superconductor and the characteristics are seriously deteriorated.

Here, the holes generating in the joint portion between the metallic electrode and the oxide superconductor will be explained with reference to FIG. 12.

FIG. 12 is a sectional view with the placement portion 230*a* at which the support portion 232*a* is provided as the center, in the power supply side metallic electrode 210.

The portion, to which the silver coat 261 is applied, of the interelectrode superconductor 260, and the in-electrode superconductor 280*a* with the silver coat 261 being applied to the entire body are placed in the interelectrode embedding groove 231*a* and the in-electrode embedding groove 221*a* which are provided in the power supply side metallic electrode 210, and joining metal 290 is provided at the joint portion constituted of them. Holes 291 generate in the joining metal 290.

When the holes 291 constitute about 10% or more of the volumetric capacity of the aforesaid joint portion, they become a cause of occurrence of a crack of the embedded oxide superconductor as described above, and when a predetermined current is passed through the current lead, they become a cause of occurrence of the contact resistance value.

The proportion of the volume of the holes 291 in the volumetric capacity of the joint portion can be measured by, for example, the following method. Namely, the joint portion is successively cut, and the ratio of the area of the section of the joint portion and the sectional area of the holes 291, which appear on each of the sectional areas, is measured, and each value is successively added up.

As the method for restraining or avoiding the generation of the holes 291 in this joining metal 290, coating of the joining metal is applied to the interelectrode embedding groove 231*a* and the like in the air first, then the interelectrode superconductor 260 and the in-electrode superconductor 280*a* are placed into the interelectrode embedding groove 231*a* and the in-electrode embedding groove 221*a* and heated, thereby melting the joining metal 290 to join them, and at this time, it is preferable to expose the portion to a vacuum, and remove the gaseous component in the joining metal 290 by the vacuum degassing method. As the condition of this vacuum degassing, the heating temperature of the joining metal 290 may be the melting point or higher, but it is desirable to make the temperature to be the melting point + about 15 to 100° C. from the viewpoint of advancing degassing in a short time and restraining oxidation of the joining metal 290. The effect can be obtained if the degree of ambient vacuum is 0.01 MPa or less, but the degree of ambient vacuum of 10 Pa or less is more desirable because degassing is completed in four to five seconds. With the temperature and the time at this level, it is not necessary to consider that the interelectrode superconductor 260 and the in-electrode superconductor 280*a* become rid of oxygen.

However, if the molten joining metal 290 flows out of the interelectrode embedding groove 231 and the in-electrode embedding groove 221*a* and diffuses to the other portions of the power supply side metallic electrode 210 on the occasion of the vacuum degassing, the amount of the joining metal becomes insufficient in the interelectrode embedding groove 231*a* and the in-electrode embedding groove 221*a*, while in the portions to which it diffuses, it becomes the cause of rise in the contact resistance value of those portions, both of which are not preferable, and it is preferable to adopt the constitution to restrain this.

When the holes 291 were reduced to about 10% or less of the volumetric capacity of the joint portion by the vacuum degassing device, a crack did not occur to the embedded oxide superconductor even when the current lead was placed in the temperature cycle of (room temperature —4.2 K). When a predetermined current was passed, the contact resistance value did not occur.

A concrete constitution example of restraining outflow of the joining metal will be explained by using FIG. 13.

Figure 13:
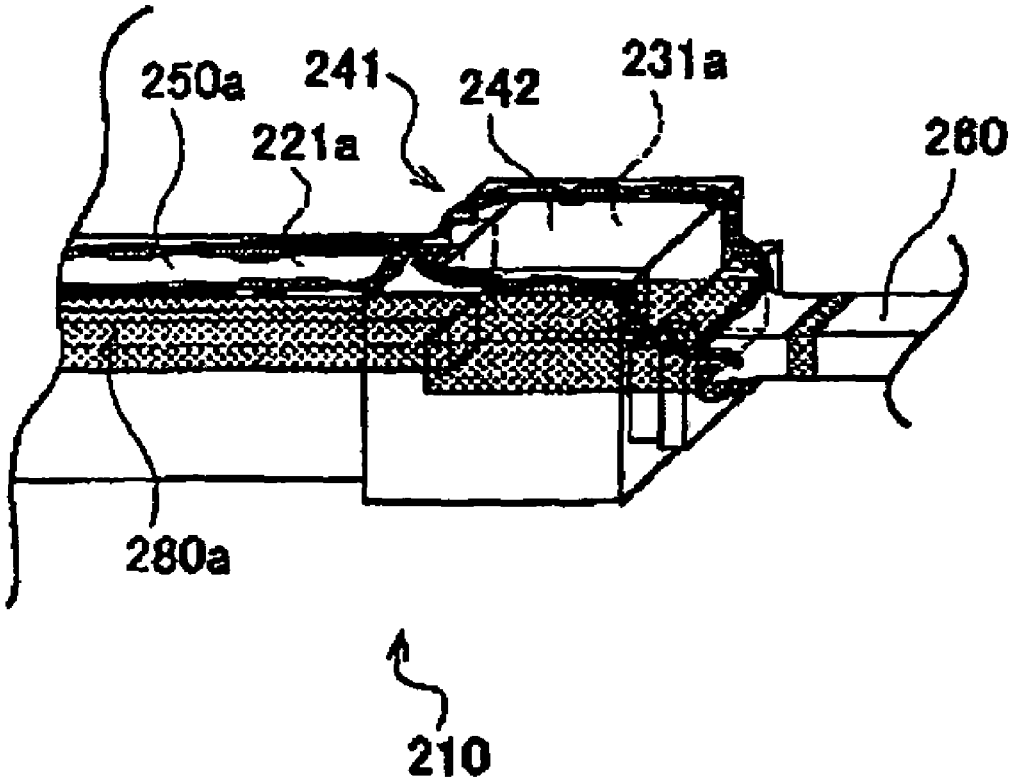
FIG. 13 is an external perspective view when a component to restrain diffusion of joining metal is provided at the joint portion of the oxide superconductor current lead according to the present invention.

FIG. 13 is an external perspective view in the case in which a constitution for restraining diffusion of the joining metal is provided in FIG. 11, which shows a state in which the interelectrode superconductor 260 and the in-electrode superconductor 280*a* are placed in the interelectrode embedding groove 231*a* and the in-electrode embedding groove 221*a* which are provided at the power supply side metallic electrode 210, and the drift current restraining member 250*a* is further placed therein.

In FIG. 13, a sealing member 241 is placed along outer periphery portions of the interelectrode embedding groove 231*a* and the in-electrode embedding groove 221*a* and the interelectrode superconductor 260. When the sealing member 241 is placed along the outer periphery portions of the interelectrode embedding groove 231*a* and the in-electrode embedding groove 221*a*, it is preferable to place the sealing member 241 so as not to close a degassing portion 242 which is formed as the clearance of this portion by fitting the drift current restraining member 250*a* into the interelectrode embedding groove 231*a* and the in-electrode embedding groove 221*a*. As the sealing member 241, silicon rubber or the like which is not deteriorated at the temperature of the melting point of the joining metal or higher, has suitable adhesiveness to the power supply side metallic electrode 210 and the interelectrode superconductor 260, and is easy to place, can be properly used.

After placement of the sealing member 241 to the power supply side metallic electrode 210 is completed, the power supply side metallic electrode 210, the interelectrode superconductor 260 and the in-electrode superconductor 280*a* are heated to the temperature higher than the melting point of the joining metal by 15 to 100° C. When vacuum degassing of the joining metal is performed according to the aforementioned condition, the generated gaseous component is discharged from the degassing portion 242. At this time, when the generated holes are difficult to rupture because the viscosity of the molten joining metal is high, it is preferable to rupture the generated holes by applying a mechanical impact with use of an ultrasonic transducer of an ultrasonic soldering iron, for example, and further perform vacuum degassing. In this embodiment, after vacuum degassing of the gaseous component from the molten joining metal is performed, the drift current restraining member 250*a* is fitted into the interelectrode embedding groove 231*a* and the in-electrode embedding groove 221*a*, and vacuum degassing is performed again. At this time, by applying the mechanical impact via the drift current restraining member 250*a*, rupture of the holes in the molten joining metal can be easily realized. As a result, it is possible to restrain the volume of the holes to 5% or less of the volumetric capacity of the joint portion, in the joining metal placed at the joint portion formed by the interelectrode embedding groove 231*a*, the in-electrode embedding groove 221*a*, the drift current restraining member 250*a*, the interelectrode superconductor 260, and the in-electrode superconductor 280*a*.

When joining of the power supply side metallic electrode 210, the interelectrode superconductor 260 and the in-electrode superconductor 280*a* is completed, the sealing member 241 is removed. As described above, it is preferable to provide a covering member between the power supply side metallic electrode 210 and the system side metallic electrode 211 provided to oppose each other at both ends of the interelectrode superconductor 260 in such a manner as to cover the interelectrode superconductor 260.

Here, referring to FIG. 14, a process step of providing the covering member on the interelectrode superconductor will be explained.

Figure 14:
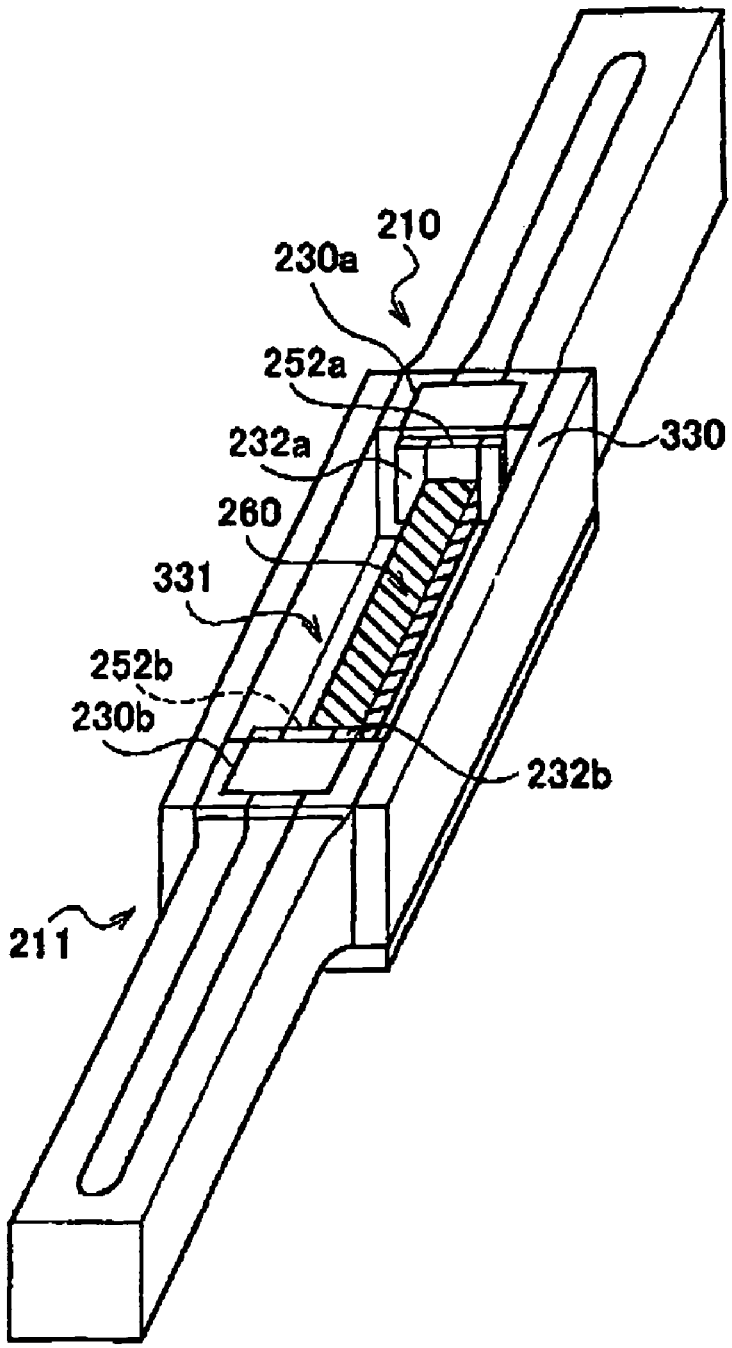
FIG. 14 is a perspective view when the interelectrode superconductor with the electrodes being joined is placed in a mold.

FIG. 14 is a perspective view showing the state in which the interelectrode superconductor 260 is placed in a mold to cover a covering member 270 on the interelectrode superconductor 260 to which the power supply side metallic electrode 210 and the system side metallic electrode 211 are joined.

The covering member 270 mechanically and environmentally protects the interelectrode superconductor 260, and therefore GFRP being the resin material including glass fibers, or the like is preferably used.

In FIG. 14, the interelectrode superconductor 260 to which the power supply side metallic electrode 210 and the system side metallic electrode 211 are joined at both ends is placed in a mold 330. The placement portions 230*a* and 230*b* of the metallic electrodes 210 and 211 at both sides, and the mold 330 having a U-shaped section form a mold space 331. The support portions 232*a* and 232*b* and the restraining member protruding portions 252*a* and 252*b* protrude toward the mold space 331 from the metallic electrodes 210 and 211 at both sides.

Meanwhile, glass fibers are impregnated with a thermoset resin to prepare pre-preg of GFRP. The prepared pre-preg of GFRP is charged into the mold space 331, and hardened by being heated to be the covering member for the interelectrode superconductor 260. As a result, the covering member is fitted onto the restraining member protruding portions 252*a* and 252*b* and the support portions 232*a* and 232*b* which protrude from the metallic electrodes 210 and 211 at both sides and exhibits mechanical strength, and therefore the current lead, which is mechanically and environmentally sturdy, and excellent in electrical characteristics, can be produced.

Connection of the produced current lead and the conductors drawn from the power supply side and the superconducting system side will be explained with reference to FIGS. 8A, 8B, 8C and 8D.

Figures 8A, 8B, 8C, 8D:
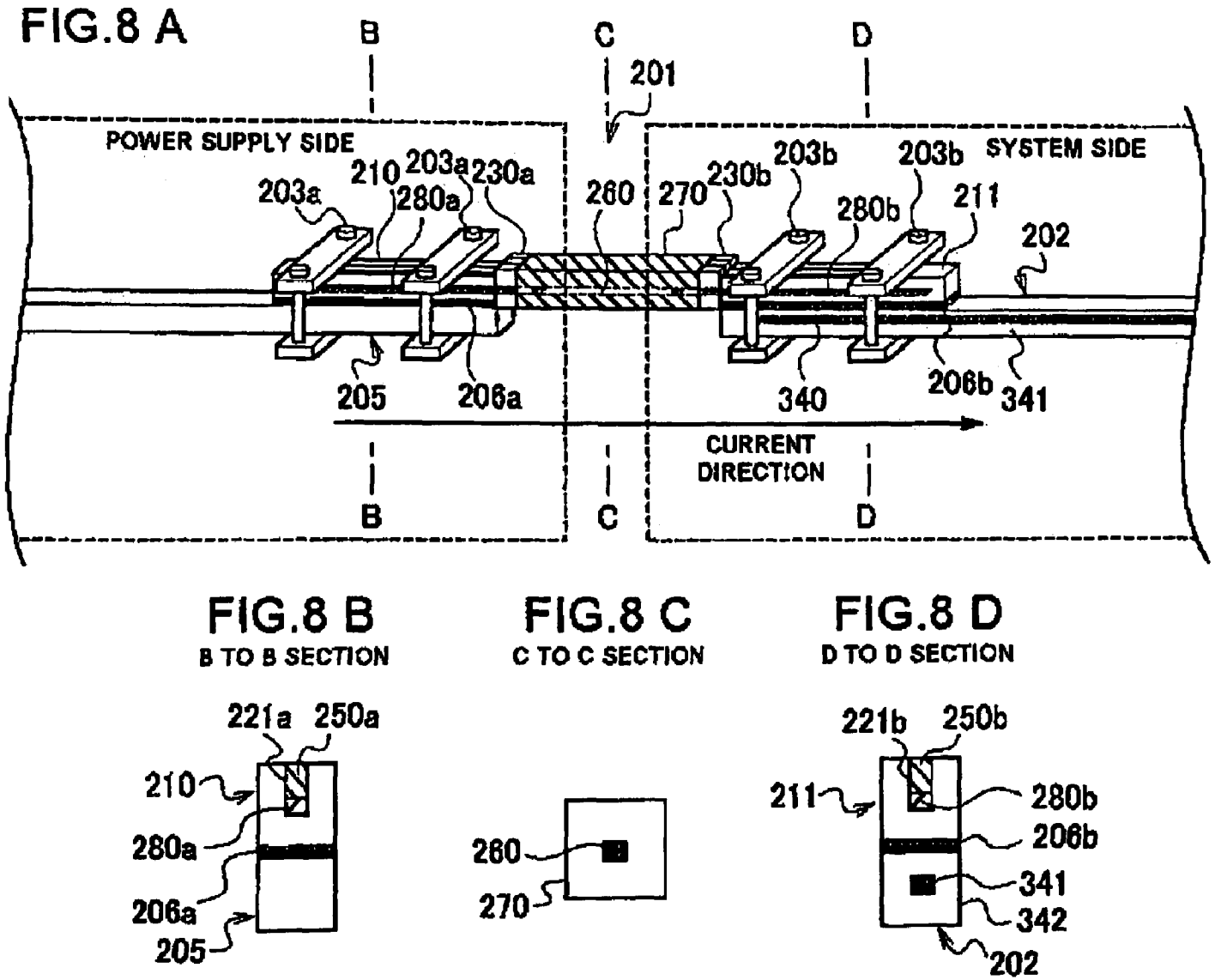
FIG. 8A is an external perspective view when the current lead according to the present invention is connected to conductors at a power supply side and a superconducting system side.
FIG. 8B is a sectional view taken along the line B to B.
FIG. 8C is a sectional view taken along the line C to C.
FIG. 8D is a sectional view taken along the line D to D.

FIG. 8A is an external perspective view when the produced current lead is connected to the conductors drawn from the power supply side and the superconducting system side, FIG. 8B is a sectional view taken along the B to B line thereof, FIG. 8C is a sectional view taken along the C to C line thereof, and FIG. 8D is a sectional view taken along the D to D line thereof.

First, in FIG. 8A, a conductor (hereinafter, described as a power supply side conductor) 205 drawn from the power supply side is joined to the power supply side metallic electrode 210 at the left side facing to the drawing, of the current lead 201, with clamps 203*a* via indium foil 206*a*. As described above, it is preferable to provide plating with the element or the alloy of tin, silver, gold, nickel, zinc, or palladium as a main component, or a layered body of the aforesaid plating on the surface of the power supply side metallic electrode 210 previously.

Here, the power supply side conductor 205 is a current path which is for supplying a current from the power supply not shown to the superconducting system not shown via the current lead 201.

In the power supply side metallic electrode 210, the in-electrode superconductor 280*a* is placed in such a manner as to be embedded therein from the substantially left end of the power supply side metallic electrode 210 to the placement portion 230*a*.

Then, this in-electrode superconductor 280*a* is joined to the interelectrode superconductor 260 in the placement portion 230*a*. The interelectrode superconductor 260 advances to the right in the drawing, separates from the power supply side metallic electrode 210 via the placement portion 230*a*, then is covered with the covering member 270 and reaches the system side metallic electrode 211, and is' joined to the in-electrode superconductor 280*b* in the placement portion 230*b*. This in-electrode superconductor 280*b* is placed from here to the substantially right end in the system side metallic electrode 211.

A system side conductor 202 is joined to this system side metallic electrode 211 with clamps 203*b* via indium foil 206*b*, similarly to the power supply side metallic electrode 210. As described above, it is preferable to provide plating with the element or the alloy of tin, silver, gold, nickel, zinc, or palladium as a main component, or a layered body of the aforesaid plating on the surface of the system side metallic electrode 211 previously.

This system side conductor 202 has a structure in which, for example, a metallic superconductor 341 is covered with an electrically-conductive covering material 342, and is a current path for supplying a current from the power supply to the superconducting system.

It is preferable to provide two or more clamps 203 at each of the electrodes at both sides, including both ends of the overlaying portion of the metallic electrode and the conductor. It is possible to join the overlaying portion of the metallic electrode and the conductor with soldering at a low melting point, but use of the clamps is preferable because they are detachable and attachable. As a result, in the in-electrode superconductor 280*a*, its longitudinal direction is in the state substantially parallel with the interfaces with the power supply side metallic electrode 210 and the power supply side conductor 205.

Next, by using FIGS. 8B to 8C, internal structures of the current lead 201, the power supply side conductor 205 and the system side conductor 202 and their joined state will be explained.

First, in FIG. 8B, the in-electrode embedding groove 221*a* is engraved in the power supply side metallic electrode 210, and the in-electrode superconductor 280*a* is placed in a bottom portion thereof. This in-electrode superconductor 280*a* is embedded in the power supply side metallic electrode 210 by the drift current restraining member 250*a*. A section of the power supply side metallic electrode 210 has substantially a quadrilateral, and its bottom surface is joined to a top surface of the power supply side conductor 205 via the indium foil 206*a*. Usually, the power supply side conductor 205 is, for example, a solid metallic rod (bar, plate).

Next, in FIG. 8C, the interelectrode superconductor 260 has its perimeter enclosed by the covering member 270, and is protected mechanically, and environmentally. Accordingly, a material, which is mechanically and environmentally strong and does not pass a current and heat, is used for the covering member 270.

Finally, in FIG. 8D, as in the power supply side metallic electrode 210, the in-electrode embedding groove 221*b* is engraved in the system side metallic electrode 211, the in-electrode superconductor 280*b* is placed in its bottom portion, and this oxide superconductor is embedded in the system side metallic electrode 211 by the drift current restraining member 250*b*. A section of the system side metallic electrode 211 is substantially quadrilateral, and its bottom surface is joined to a top surface of the system side conductor 202 via the indium foil 206*b*. The system side conductor 202 has the structure in which, for example, the metallic superconductor 341 is covered with the electrically-conductive covering material 342 as described above.

Here, returning to FIG. 8A, the current which is originated from the power supply, passes through the power supply side conductor 205, the current lead 201 and the system side conductor 202 and reaches the superconducting system will be explained. Concerning the passage of this current, detailed elucidation is under study yet, but it is generally considered as follows.

For convenience, with the interelectrode superconductor 260 as the border, the left side, facing to the drawing, is called the power supply side, and the right side is called the system side.

When the current lead is used, the power supply side is cooled by, for example, liquid nitrogen cooling (77 K) and the system side is cooled by, for example, liquid helium cooling (4.2 K). Then, the interelectrode superconductor 260, the in-electrode superconductors 280*a* and 280*b* are in the superconducting state. As a result, the supply side metallic electrode 210 and the system side metallic electrode 211 decrease in the potential difference over the substantially entire length thereof.

Here, it is considered that the current passing through the power supply side conductor 205 from the left side in the drawing gradually passes into the power supply side metallic electrode 210 substantially uniformly over substantially the entire region of the overlaying portions of the power supply side conductor 205 and the power supply side metallic electrode 210. Consequently, even if the drift current of the current occurs microscopically due to the state of the metal and variations in the joined state, it is averaged macroscopically, and therefore the contact resistance can be sharply restrained (details will be explained in examples, but it is restrained to substantially one tenth), thus making it possible to restrain generation of Joule heat.

The current passing into the oxide superconductor reaches the system side metallic electrode 211 without generating Joule heat. Then, while the contact resistance is sharply restrained over the substantially all the region of the overlaying portion of the system side conductor 202 and the system side metallic electrode 211 by the same mechanism as explained in the power supply metallic electrode (details will be described in examples, and the contact resistance is reduced to substantially one tenth), the current passes into the system side conductor 202, and further passes into the metallic superconductor 341 to reach the superconducting system. As a result, generation of Joule heat is also sharply restrained in the system side.

In order to obtain the effect of sharply reducing the constant resistance values at the joint portion of the aforementioned power supply side conductor 205 and the power supply side metallic electrode 210 and at the joint portion of the system side conductor 202 and the system side metallic electrode 211, it is suitable that the power supply side conductor 205 and the power supply side metallic electrode 210, and the system side conductor 202 and the system side metallic electrode 211 are placed to overlap so that the end portions of each other are placed at the positions back from the end portions of each other. Though it is preferable that the degree of overlapping of both of them is larger, the effect of the present invention can be obtained if the overlapping surface area is larger than the total of the sectional area which each at the conductor side has, and the sectional area which each at the electrode side has.

From the above, by using the current lead for the superconducting system, cooling efficiency of the superconducting system is remarkably improved, and reduction of the production cost by making the cryocooler capacity compact and the like, and running cost reduction of the system can be realized.

The embodiment of the present invention will be further explained in detail based on the examples, hereinafter.

EXAMPLE 1

1) Production of the Oxide Superconductor

Each raw material powder of $Gd_2O_3$, $BaCO_3$, and CuO was weighed so that Gd: Ba: Cu=1:2:3 in the mole ratio and mixed, then calcined at 920° C. for 30 hours, thereafter ground into the average grain size of 3 μm with use of the pot mill, and calcined again at 930° C. for 30 hours and ground into the average grain size of 10 μm in the mixing and grinding machine, and the pot mill, whereby the powder of $Gd_1Ba_2Cu_3O_{7-x}$ which was the first calcined powder was prepared. Next, the aforesaid each raw material powder was weighed so that Gd:Ba: Cu=2:1:1 and mixed, then calcined at 890° C. for 20 hours, and ground into the average grain size of 0.7 μm with use of the pot mill, whereby the powder of $Gd_2BaCuO_5$, which was the second calcined powder, was prepared.

The first and the second calcined powders were weighed so that $Gd_1Ba_2Cu_3O_{7-x}$: $Gd_2BaCuO_5$=1:0.4, and Pt powder (average size of 0.01 μm) and $Ag_2O$ powder (average grain size of 13.8 μm) were added and mixed to prepare the synthetic powder. It should be noted that the Pt content was 0.42 wt % and the Ag content was 15 wt %.

This synthetic powder was press-molded with use of the plate-shaped mold, and the precursor, which was 77 mm long, 105 mm wide and 26 mm thick, was produced. Then, this precursor was placed in the furnace and the following process steps were performed.

First, the temperature was raised from the room temperature to 1100° C. in 70 hours, and after the precursor was kept at this temperature for 20 minutes and brought into the semi-molten state, the temperature gradient of 5° C./cm was applied from the top to the bottom of the precursor so that the top portion of the precursor was at the low temperature side, and the temperature was reduced at 0.4° C./min until the temperature of the top portion became 995° C.

Here, the crystal, which was produced by cutting the crystal of the composition of $Nd_{1.8}Ba_{2.4}Cu_{3.4}O_x$ including 0.5 wt % of Pt without including Ag which was previously prepared by the melting method to be 2 mm long and wide and 1 mm thick, was used as the seed crystal, and this seed crystal was brought into contact with the center of the top portion of the precursor so that the growth direction was in parallel with the c axis. The temperature of the top portion of the precursor was reduced at the speed of 1° C./hr from 995° C. to 985° C. After the precursor was kept at this temperature for 100 hours, it was gradually cooled to 915° C. for the time period of 70 hours, and thereafter, the bottom portion of the precursor was cooled to 915° C. in 20 hours so that the temperature gradient from the top to the bottom became 0° C./cm. Thereafter, the precursor was gradually cooled to the room temperature for the time period of 100 hours, thereby performing crystallization, and the crystal sample of the oxide superconductor was obtained.

When the crystal sample of this oxide superconductor was cut in the vicinity of the center in the up-and-down direction and the section was observed with the EPMA, the $Gd_{2+r}Ba_{1+s}(Cu_{1-d}Ag_d)O_{5-y}$ phases of about 0.1 to 30 μm were microscopically dispersed in the $Gd_{1+p}Ba_{2+q}(Cu_{1-b}Ag_b)_3O_{7-x}$ phase.

Here, each of p, q, r, s, and y had the value of −0.2 to 0.2, and x had the value of −0.2 to 0.6. Each of b and d had the value of 0.0 to 0.05, and the average was about 0.008. Ag of about 0.1 to 100 μm dispersed microscopically over the entire crystal sample. The holes of the grain size of about 5 to 200 μm dispersed under the portion at the 1 mm from the surface. The entire crystal sample reflected the seed crystal, and was oriented uniformly so that the thickness direction of the disc-shaped material was in parallel with the c-axis, the deviation of the orientation between the adjacent crystals was 3 degrees or less, and thus the crystal sample in the substantially single-crystal form was obtained. When the portion under the 1 mm from the surface of this crystal sample was cut out and the density was measured, it was 7.0 g/cm$^3$ (91.1% of the theoretical density of 7.68 g/cm$^3$).

The oxide superconductor in the constricted shape to be used for the interelectrode superconductor, and the columnar oxide superconductor to be used for the in-electrode superconductor were cut out from the portion under the 1 mm from the surface of the obtained crystal sample according to the following method.

The oxide superconductor in the constricted shape is 3 mm thick and 87 mm in the total length in the longitudinal direction, and has the constricted shape with the portions which are substantially 10 mm from both ends in the longitudinal direction being 10 mm wide, and the intermediate portion which is substantially 67 mm is 4 mm wide.

The columnar oxide superconductor has the shape which is 3 mm thick, 87 mm in the entire length in the longitudinal direction, and 4 mm wide.

These oxide superconductors were cut out from the crystal sample so that their longitudinal directions are in parallel with the ab plane of the crystal. It should be noted that two of the columnar oxide superconductors were cut out therefrom.

When the temperature dependency of the thermal conductivity of this material was measure after the subsequent annealing treatment, it was about 141 mW/cmK in the integration average value from the temperature of 77 K to 10 K, which was a low value, irrespective of inclusion of 15 wt % of silver.

2) Silver Coat Placement to the Columnar Oxide Superconductor

First, the organic vehicle prepared by mixing 10 wt % of ethyl cellulose, 30 wt % of terpineol, 50 wt % of dibutyl phthalate, and 10 wt % of butyl Carbitol acetate, and Ag powder of the average grain size of 3 μm were mixed in proportions of 3:7 in the weight ratio, to which phosphate ester was added by 2%, whereby the Ag paste was prepared.

Next, the prepared. Ag paste was coated onto the oxide superconductors.

First, in the oxide superconductor in the constricted shape prepared in 1), the prepared Ag paste of 50 μm thick was coated on the entire surfaces of the width-expanded portions of 10 mm at the both end portions, and on the portions of 2 mm wide at the positions from 15 mm from both left and right end portions. Similarly, the entire surfaces of the two columnar oxide superconductors were coated with the Ag paste of 50 μm thick.

After the vacuum impregnation treatment was performed for the oxide superconductors coated with the Ag paste, they were dried in the oven at 80° C. in the air. Next, the three oxide superconductors coated with the Ag paste were calcined in the furnace body at 920° C. for 10 hours to bake Ag thereto to make it the silver coat, and the silver coat oxide superconductors were produced. The film thickness of Ag after baking was about 30 μm.

3) Annealing Treatment of the Silver Coat Oxide Superconductors

The silver coat oxide superconductors were placed in another furnace capable of gas replacement, and after the inside of the furnace was evacuated with the rotary pump to 0.1 Torr, an oxygen gas was fed into the furnace to provide the atmosphere at the atmospheric pressure with the oxygen partial pressure being 99% or more. Thereafter, while an oxygen gas was fed into the furnace at the flow rate of 0.5 L/min, the temperature was raised to 450° C. from the room temperature for 10 hours, then it was gradually reduced from 450° C. to 250° C. for the time period of 400 hours, and was further reduced to the room temperature from 250° C. in 10 hours, whereby the annealing treatment of the silver coat superconductors was performed.

4) Production of the Metallic Electrodes and the Drift Current Restraining Members The metallic electrodes and the drift current restraining members were produced by working the oxygen-free copper of the purity of 4 N, and Sn plating was applied to each surface.

The outer shape was 110 mm in the entire length, 15 mm wide (one side of 10 mm is expanded to be 20 mm in width to be provided with the placement portion), and 15 mm thick (one side of 10 mm is expanded to be 20 mm in width to be provided with the placement portion). Further, the interelectrode embedding groove is engraved in the metallic electrode from the placement portion to the support portion, and the in-electrode embedding groove is engraved to the longitudinal direction of the metallic electrode in the shape to continue from this interelectrode embedding groove. The depth of the grooves is 10 mm, and the width is expanded to be larger by substantially 0.5 mm than the width of the oxide superconductors, so that the oxide superconductor is located at the central portion of the metallic electrode and can keep a space of substantially 0.5 mm from the inner walls of the both embedding grooves.

Meanwhile, after both the oxide superconductors were placed into both the embedding grooves of the metallic electrode, the drift current restraining member was made to be capable of being integrated with the outer shape of the metallic electrode by being fitted into the both embedding grooves. However, in this situation, the drift current restraining member was made to be capable of keeping the space of substantially 0.5 mm from the inner walls of both the embedding grooves of the metallic electrode and both the oxide superconductors.

5) Placement of the Oxide Superconductor into the Metallic Electrodes

Melt-coating of Cerasolzer 143 (hereinafter, described as Cerasolzer), which is the PbSn based solder, was applied onto the both embedding grooves of the metallic electrodes as the joining metal. Meanwhile, melt-coating of Cerasolzer was also applied to the silver coat portions of both the oxide superconductors.

Then, the oxide superconductor in the constricted shape in which melt-coating of Cerasolzer was applied to the end portions of 10 mm provided with the: silver coat portions was placed into the interelectrode embedding grooves of the metallic electrodes, and heated and cooled to be temporarily fixed. Next, the columnar oxide superconductors, which were provided with the silver coat portions on the entire surfaces and to which melt-coating of Cerasolzer was applied, were placed into the in-electrode embedding grooves of the metallic electrodes, and heated and cooled to be temporarily fixed. When the temporary fixing is completed, the heat-resisting silicon rubber was provided as the sealing members from the outer peripheries of the protruding portions of the interelectrode oxide superconductor to the outer edge portions of the support portions and the embedding grooves to perform the treatment which prevents the outflow of the Cerasolzer.

6) Degassing Treatment of the Joining Metal

After the outflow prevention treatment was completed, the metallic electrodes were heated at 180° C. which was higher than the melting point (143° C.) of the Cerasolzer to melt the Cerasolzer sufficiently, and they were quickly put into the vacuum container to perform degassing at about 100 Pa for two minutes. Subsequently, the metallic electrodes were heated to 180° C. again, and the drift current restraining members on which the melt-coating of the Cerasolzer was previously applied were applied to the superconductors placed in the metallic electrodes each in such a manner as to put a lid thereon, and they were put into the vacuum container again to perform degassing at about 100 Pa for two minutes. Subsequently, a mechanical impact was applied via the drift current restraining members by the ultrasonic soldering iron, and the existing holes of the Cerasolzer were ruptured.

As a result of this, the metallic electrodes, both the oxide superconductors, and the drift current restraining members were joined in the electrically and mechanically preferable state with the joining metal without including the holes. When the joining was completed, the sealing members were removed.

In this example, in order to measure the characteristics of the produced current lead, the stainless steel lead wires with the diameter of 0.1 mm for characteristics measurement were connected to the silver coat portions, which were provided at the positions of 15 to 17 mm from the ends of the oxide superconductor, by using the Cerasolzer.

7) Placement of the Covering Member

The adhesive of the thermosetting epoxy resin composed of bisphenol A-type epoxy resin and aromatic amine was prepared, and vacuum-impregnated to the glass cloth fibers and the chopped glass fibers, to be the pre-preg of the GFRP. Next, the oxide superconductor provided with the metallic electrodes at the both ends, which was produced in 6), was placed in the mold, so that only the oxide superconductor between the metallic electrodes and the support portions of the metallic electrodes were covered with the GFRP. The pre-preg of the chopped glass fibers was charged into the mold space around the oxide superconductor, and was thermally set at 120° C., whereby the oxide superconductor current lead sample covered with the chopped glass fibers and epoxy resin was produced.

8) Evaluation of the Characteristics of the Current Lead

Here, in order to evaluate the effect given to the contact resistance value of the current lead by the in-electrode oxide superconductor embedded in the metallic electrode, which is the feature of the present invention, the oxide superconductor current lead sample for comparison, which was similar to the current lead according to the present invention except that the in-electrode superconductor and the in-electrode embedding groove were not provided, was also produced.

The method for evaluating the effect given to the contact resistance value of the current lead by the in-electrode oxide superconductor by using the current lead according to the present invention and the current lead for comparison will be explained with reference to FIG. 15A to FIG. 15C.

Figures 15A, 15B, 15C:
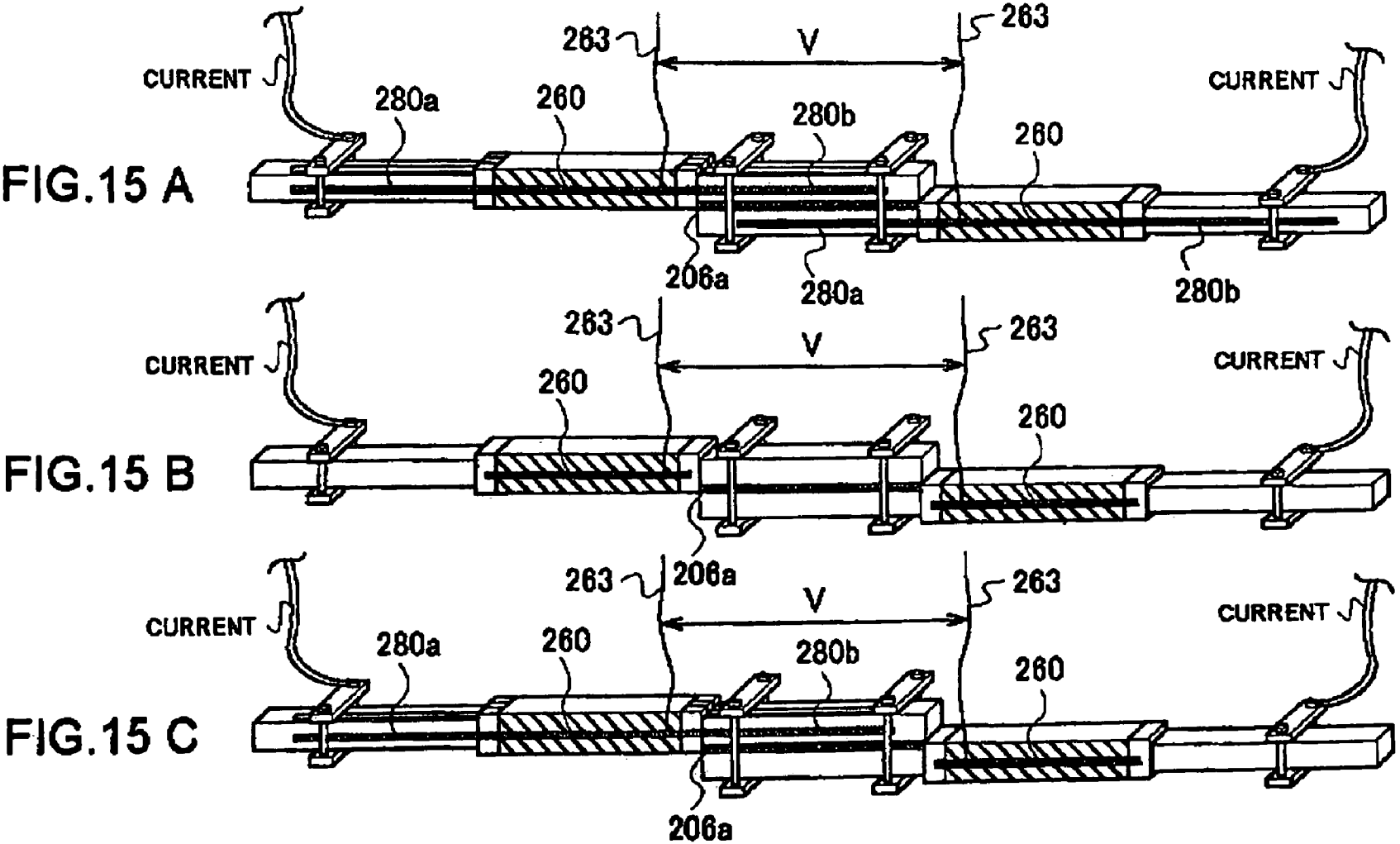
FIGS. 15A, 15B and 15C are schematic perspective views of the occasion of evaluation of the characteristics of the oxide superconductor current leads according to examples and a comparison example.

Here, FIG. 15A is an external perspective view of the state in which two of the current leads according to the present invention are prepared, the power supply side metallic electrodes or the system side metallic electrodes of them are joined with the clamps via the indium foil of 0.1 mm thick (since the both electrodes have the same constitutions as described above, either of them may be selected, and in this embodiment, the system side metallic electrodes 211 of each other were joined), and the cables from the power supply were connected to the power supply side metallic electrodes of each other which were not joined. This connecting state corresponds to the state in which the current lead of this embodiment and the system side superconductor extended from a superconducting magnet coil or the like are joined.

FIG. 15B is an external perspective view of the state in which two of the current leads for comparison are prepared and joined as in FIG. 15A. This connecting state corresponds to the state in which the current lead according to the prior art and the normal conducting conductor extended from a power supply or the like are joined to the power supply side metallic electrode.

FIG. 15C is an external perspective view of the state in which one of the current lead according to the present invention and one of the current lead for comparison are prepared, and these two are joined as in FIG. 15A. This connecting state corresponds to the state in which the current lead 201 of the invention of the present application and the normal conducting conductor extended from a power supply or the like are joined to the power supply side metallic electrode.

The three kinds of the joined couples of current leads were cooled to 77 K and 4.2 K, the current up to 1060 A was passed in them at the intervals of 10 A, and the voltage between the stainless wires each attached to the position of 15 mm from the end of the superconductor 260 for passing the current between the metallic electrodes of each of the current leads was previously measured, and from the gradient of the V-I characteristics; each contact resistance value R occurring to the joined portion between the current leads was calculated.

FIG. 16 is the list of the calculation result of the characteristics of the current lead according to the example 1.

From the calculation result shown in FIG. 16, the values of the contact resistance value R were 0.28 μΩ at 77 K; and 0.2 μΩ at 4.2 K in the current lead according to the present invention. In contrast to this, in the current lead for comparison, the values were 3.23 μΩ at 77 K, and 2.6 μΩ at 4.2 K, and in the intermediate case in which the current lead according to the present invention and the current lead for comparison were mixed, the values were 1.52 μΩ at 77 K, and 1.22 μΩ at 4.2 K.

As is obvious from this result, when the values of the contact resistance value R were compared between the current lead according to the invention of the present application and the current lead for comparison, it was revealed that the current lead according to the present invention has the effect of reduction to about ½ when the mating side was the normal conducting wire, and reduction to about 1/10 when the mating side was the superconducting wire.

The heat penetration amount by heat transfer from the high temperature side to the low temperature side, when the low temperature side of the current lead sample according to this embodiment was cooled to 4.2 K and the high temperature side was cooled to 77 K, was 0.28 W.

The current lead sample of this embodiment was placed at 77 K, in the magnetic field of 0.5 T, and the critical current value was measured by passing the current of up to 2000 A, but there is no occurrence of resistance in the interelectrode superconductor, and the critical value was 2000 A or more. Thus, when the effective sectional area dared to be reduced by grinding the section of the superconductor sample from 3 mm×4 mm to ϕ 2 mm, and the current passage test was conducted again, the critical current value was 610 A. From this result, this value was converted into the critical current value in this current lead sample, and it was revealed that the value corresponds to about 2330 A in the magnetic field of 0.5 T.

From the above, when the current of 1000 A is passed in the magnetic field of 0.5 T with one of the metallic electrodes being as the high temperature side (77 K) and the other one being as the low temperature side (4.2 K) in the current lead sample, Joule heat generation amount at the low temperature side was improved to 0.2 W from 2.6 W of the prior art, and that at the high temperature side was improved to. 0.28 W from 2.6 W of the prior art to be sharply reduced. Consequently, the cooling efficiency was remarkably improved, and reduction in production cost by making the cryocooler capacity compact and the like and reduction in running cost of the system can be realized.

Finally, the metallic electrode portions of the current lead sample were cut, and what percentage of the volumetric capacity of the joint portion the volume of the holes in the joining metal placed at each of the joint portions of the oxide superconductors and the metallic electrodes constituted was measured. As a result, it was revealed that volume of the holes in the joining metal constituted about 0.1% of the volumetric capacity of each of the joining portions on the left and the right.

EXAMPLE 2

1) Production of the Oxide Superconductor

After each raw material powder of $Sm_2O_3$, $BaCO_3$, and CuO was weighed so that Sm:Ba:Cu=1.6:2.3:3.3 in the mole ratio, only $BaCO_3$ and CuO were calcined at 880° C. for 30 hours, and calcined powder of $BaCuO_2$ and CuO was obtained ($BaCuO_2$: CuO=2.3:1.0 in the mole ratio). Next, The aforesaid $Sm_2O_3$ which was previously weighed was added to this calcined powder, to which Pt powder (average grain size of 0.01 μm) and $Ag_2O$ powder (average grain size of 13.8 μm) were further added and mixed, and this was calcined in the air at 900° C. for 10 hours to be the calcined powder including Ag. It should be noted that Pt content was 0.42 wt % and Ag content was 15 wt %. The calcined powder including Ag was ground by the pot mill, the average grain size was made about 2 μm, and the synthetic powder was obtained.

When the obtained synthetic powder was analyzed by powder X-ray diffraction, an $Sm_{1+p}Ba_{2+q}(Cu_{1-b}Ag_b)_3O_{7-x}$ phase and an $Sm_{2+r}Ba_{1+s}(Cu_{1-d}Ag_d)O_{5-y}$ phase were confirmed.

This synthetic powder is press-molded into a plate-shape which is 77 mm long, 106 mm wide and 26 mm thick, and thereby the precursor was produced. Then, this precursor was placed in the furnace and the following process steps were performed.

First, the temperature was raised from the room temperature to 1100° C. in 70 hours, and after the precursor was kept at this temperature for 20 minutes and brought into the semi-molten state, the temperature gradient of 5° C./cm was applied from the top to the bottom of the precursor so that the top portion of the precursor was at the low temperature side, and the temperature was reduced at 0.4° C./min until the temperature of the top portion became 1025° C.

Here, the crystal, which was produced by cutting the crystal of the composition of $Nd_{1.8}Ba_{2.4}Cu_{3.4}O_x$ including 0.5 wt % of Pt without including Ag, which was previously produced by the melting method, to be 2 mm long and wide and 1 mm thick, was brought into contact with the center of the top portion of the precursor so that the growth direction was in parallel with the c-axis. The temperature of the top portion was reduced at the speed of 1° C./hr from 1025°° C. to 1015° C. After the precursor was kept at this temperature for 100 hours, it was gradually cooled to 945° C. for the time period of 70 hours, and thereafter, the bottom portion of the precursor was cooled to 945° C. in 20 hours so that the temperature gradient from the top to the bottom became 0° C./cm. Thereafter, the precursor was gradually cooled to the room temperature for the time period of 100 hours, thereby performing crystallization of the precursor, and the crystal sample of the oxide superconductor was obtained.

When the crystal sample of this oxide superconductor was cut in the vicinity of the center in the up-and-down direction and the section was observed with the EPMA, the $Sm_{2+r}Ba_{1+s}(Cu_{1-d}Ag_d)O_{5-y}$ phases of about 0.1 to 30 μm were microscopically dispersed in the $Sm_{1+p}Ba_{2+q}(Cu_{1-b}Ag_b)_3O_{7-x}$ phase.

Here, each of p, q, r, s, and y had the value of −0.2 to 0.2, and x had the value of −0.2 to 0.6. Each of b and d had the value of 0.0 to 0.05, and the average was about 0.008. Ag of about 0.1 to 100 μm dispersed microscopically over the entire crystal sample. The holes of the size of 5 to 200 μm dispersed under the portion at the 1 mm from the surface. The entire crystal sample reflected the seed crystal, and was oriented uniformly so that the thickness direction of the disc-shaped material was in parallel with the c-axis, the deviation of the orientation between the adjacent crystals was 3 degrees or less, and thus the substantially single-crystal crystal sample was obtained. When the portion under the 1 mm from the surface of this crystal sample was cut out and the density was measured, it was 6.87 g/cm$^3$ (91.2% of the theoretical density of 7.53 g/cm$^3$).

The oxide superconductor in the constricted shape and two of the columnar oxide superconductors were cut out from the portion under the 1 mm from the surface of the obtained crystal sample, as in the example 1.

When the temperature dependency of the thermal conductivity of this sample was measured after the subsequent annealing treatment, it was about 113 mW/cmK in the integration average value from the temperature of 77 K to 10 K, which was a low value irrespective of inclusion of 15 wt % of silver.

Thereinafter,

2) Silver coat placement onto the oxide superconductor in the constricted shape and the columnar oxide superconductors 3) Annealing treatment of the silver coat oxide superconductors 4) Production of the metallic electrodes and the drift current restraining members 5) Placement of the oxide superconductors into the metallic electrodes 6) Degassing treatment of the joining metal 7) Placement of the covering member 8) Evaluation of the characteristics of the current lead were performed similarly to the example 1.

FIG. 17 is the list of the calculation result of the characteristics of the current leads according to the example 2.

When the values of the contact resistance value R were compared between the current lead according to the invention of the present application and the current lead for comparison from the calculation result shown in FIG. 17, it was revealed that the effect of reducing the value to about ½ was provided in the case in which the mating conductor is the normal conductor, and the effect of reducing the value to about 1/10 was provided in the case in which the mating conductor was the superconductor.

The heat penetration amount by heat transfer to the low temperature side when the low temperature side of this current lead sample was cooled to 4.2 K, and the high temperature side was cooled to 77 K, was 0.25 W.

Further, when the critical current value of the current lead sample at 77 K in the magnetic field of 0.5 T was measured by passing the current up to 2000 A, it was revealed that the resistance did not occur to the interelectrode superconductor, and the critical current value was 2000 A or more. Thus, when the effective sectional area was reduced by grinding the section of the superconductor sample from 3 mm×4 mm to ϕ 2 mm, and the current passage test was conducted again, the critical, current value was 630 A. If this result is converted into 3 mm×5 mm in the current lead sample, the value corresponds to about 2400 A in the magnetic field of 0.5 T.

From the above, when the current of 1000 A is passed in the magnetic field of 0.5 T with the one of the metallic electrodes being as the high temperature side (77 K) and the other one being as the low temperature side (4.2 K) in the current lead sample, the Joule heat generation amount at the low temperature side was improved to 0.21 W from 2.65. W of the prior art, and that at the high temperature side was improved to 0.27 W from 3.5 W of the prior art, which are very low values, and therefore cooling efficiency is remarkably improved, which makes it possible to realize reduction in the running cost of the system and reduction in the cryocooler capacity.

Finally, the joint portions at the both sides of the current lead sample were cut, and what percentage of the volumetric capacity of the joint portion the volume of the holes in the joining metal placed at each of the joint portions constituted was measured. As a result, it was confirmed that the each of the volumes of the holes in the joining metal at the left and the right constituted about 0.1% of the volumetric capacity of the joint portion, and therefore the joining metal was charged therein densely.

What is claimed is:

1. An oxide superconductor current lead in which metallic electrodes are provided at both sides of a rare-earth based oxide superconductor manufactured by a melting method, joining metal is provided at joint portions formed by said oxide superconductor and said metallic electrodes, and said oxide superconductor and said metallic electrodes are joined by the joining metal, wherein a volume of holes in the joining metal provided at the joint portions is 5% or less of a volumetric capacity of the joint portions, and a current resistance value is 0.5 μΩ or less when a current of 1000 A is flown.

2. The oxide superconductor current lead according to claim 1, wherein silver coat is provided on a surface of said oxide superconductor joined by the joining metal.

3. The oxide superconductor current lead according to claim 1, wherein the joining metal is solder including one or more kind or kinds of cadmium, zinc, and antimony, and one or more kind or kinds of lead, tin, and indium.

4. A superconducting system, wherein the oxide superconductor current lead according to claim 1.

5. An oxide superconductor current lead which is provided with metallic electrodes at both ends of a rare-earth based oxide superconductor manufactured by a melting method, and transfers a current from and to mating conductors joined to said metallic electrodes, wherein in at least one of said metallic electrodes, said metallic electrodes and the mating conductors are disposed so as to be overlapped on each other, and a surface area of this overlapped part is larger than a sum of sectional areas of the metallic electrodes and sectional areas of the mating conductors.

6. The oxide superconductor current lead according to claim 5, wherein said oxide superconductor has a columnar shape, and is placed so that a longitudinal direction thereof is substantially in parallel with the interface.

7. The oxide superconductor current lead according to claim 5, wherein said oxide superconductor is an oxide superconductor produced by a melting method.

8. The oxide superconductor current lead according to claim 5, wherein said oxide superconductor is an oxide superconductor made by joining a plurality of oxide superconductors.

9. The oxide superconductor current lead according to claim 5, wherein said metallic electrodes and said one or more superconductor or superconductors are joined by joining metal, and wherein a volume of holes in the joining metal constitutes 5% of a volumetric capacity of joint portions or less.

10. A superconducting system, wherein the oxide superconductor current lead according to claim 5.

* * * * *